US008774702B2

(12) United States Patent
Sekigawa

(10) Patent No.: US 8,774,702 B2
(45) Date of Patent: Jul. 8, 2014

(54) SHEET POST-PROCESSING APPARATUS AND IMAGE FORMING APPARATUS HAVING THE SAME

(75) Inventor: Akito Sekigawa, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 388 days.

(21) Appl. No.: 12/688,449

(22) Filed: Jan. 15, 2010

(65) Prior Publication Data

US 2010/0187742 A1 Jul. 29, 2010

(30) Foreign Application Priority Data

Jan. 26, 2009 (JP) ..... 2009-014686
Dec. 28, 2009 (JP) ..... 2009-296650

(51) Int. Cl.
*B65H 29/66* (2006.01)
*G03G 15/00* (2006.01)

(52) U.S. Cl.
CPC ..... *B65H 29/6609* (2013.01); *B65H 29/6654* (2013.01); *G03G 15/6552* (2013.01)
USPC ..... 399/405; 399/410; 270/58.11; 271/216

(58) Field of Classification Search
CPC ..... B65H 29/66; B65H 29/6609; B65H 29/6654; B65H 2801/27; B65H 2301/444; G03G 15/6552
USPC ..... 399/405, 407, 408, 410; 271/207, 216, 271/288, 298; 270/58.11, 58.12, 58.17, 270/58.27
See application file for complete search history.

(56) References Cited

U.S. PATENT DOCUMENTS 4,434,979 A * 3/1984 Kobler et al. ..... 271/307
2007/0045919 A1* 3/2007 Hayashi ..... 270/32
2007/0090582 A1* 4/2007 Awano ..... 270/37

FOREIGN PATENT DOCUMENTS

JP 2007-119089 A 5/2007
JP 2008-184311 8/2008

* cited by examiner

*Primary Examiner* — Daniel J Colilla
*Assistant Examiner* — Blake A Tankersley
(74) *Attorney, Agent, or Firm* — Fitzpatrick, Cella, Harper & Scinto

(57) ABSTRACT

There are provided a sheet post-processing apparatus which can reliably stack a sheet bundle in imbricated state without bending it and an image forming apparatus having the same. A sheet post-processing apparatus includes: a stacking portion which stacks a folded sheet bundle subjected to the folding process; a discharge portion which discharges the folded sheet bundle onto the stacking portion with the folded end thereof set to the leading position; and a conveying portion which conveys the folded sheet bundle stacked onto the stacking portion, wherein the conveying portion starts the conveyance of a previous folded sheet bundle at the timing at which the folded end of a next folded sheet bundle discharged by the discharge portion is abutted onto the previous folded sheet bundle which is being conveyed to the downstream side in the discharge direction.

19 Claims, 20 Drawing Sheets

SHEET POST-PROCESSING APPARATUS AND IMAGE FORMING APPARATUS HAVING THE SAME

BACKGROUND OF THE INVENTION

1. Field of the Invention

The present invention relates to a sheet post-processing apparatus which discharges a folded sheet bundle to be stacked in imbricated state and an image forming apparatus having the same.

2. Description of Related Art

Some of image forming apparatuses of the related art forming images on sheets, such as copying machines and laser beam printers, have a sheet post-processing apparatus which bundles the image-formed sheets, performs the binding process for the sheet bundle and the folding process, and make a booklet.

Such sheet post-processing apparatus stacks the image-formed sheets onto a tray, bundles them, and performs the binding process at the substantially center vicinity of the sheet bundle. The substantially center vicinity of the sheet bundle is pushed out by a pushout member. The sheet bundle is pushed into between the nips of a pair of folding rollers. While being conveyed by the folding rollers, the sheet bundle is performed the folding process. The strengthening process of the folded end of the sheet bundle is performed. The sheet bundle is discharged and stacked onto a folded sheet bundle tray.

In the case of discharging and stacking the sheet bundle onto the folded sheet bundle tray, as illustrated in FIG. 20, a sheet bundle P1 stacked onto a folded sheet bundle tray 840 is located outside the moving region of a press unit 860 while performing the folded end process for the next sheet bundle P2. The sheet bundle P1 is returned to near a pair of folding conveying rollers 812 before the sheet bundle P2 performed the folded end process is discharged.

In Japanese Patent Application Laid-Open No. 2008-184311, the amount of return is determined according to the type of sheet used so that the leading end of the sheet bundle P2 is located on downstream in the discharge direction of the trailing end of the sheet bundle P1 when the sheet bundle P2 is discharged. The sheet bundle P2 is stacked in imbricated state, thereby preventing sheet jamming and sheet folding.

In the sheet post-processing apparatus of the related art, when the leading end of the sheet bundle P2 is abutted onto the sheet bundle P1, the conveyance of the sheet bundle P1 to downstream in the discharge direction has not been started. In the case of discharging the sheet bundle P2 which is a sheet bundle including sheets forming it which have low rigidity and a few number of sheets, the sheet bundle P2 can easily hang down in the substantially vertical direction. As illustrated in FIGS. 18 and 19, the leading end of the sheet bundle P2 is abutted onto the sheet bundle P1, the sheet bundle P2 is bent and rounded, and stacking failure can be caused.

The present invention provides a sheet post-processing apparatus which can reliably stack a sheet bundle in imbricated state without bending it and an image forming apparatus having the same.

SUMMARY OF THE INVENTION

A sheet post-processing apparatus according to the present invention includes: a stacking portion on which a folded sheet bundle is stacked; a discharge portion which discharges the folded sheet bundle onto the stacking portion with the folded end thereof set to the leading position; and a conveying portion which conveys the folded sheet bundle stacked onto the stacking portion, wherein the conveying portion starts the conveyance of a previous folded sheet bundle so that the folded end of a next folded sheet bundle discharged by the discharge portion is abutted onto the previous folded sheet bundle while being conveyed to downstream in the discharge direction.

The representative configuration of an image forming apparatus according to the present invention includes an image forming portion which forms images on sheets, and the sheet post-processing apparatus which post-processes a sheet bundle including a plurality of image-formed sheets.

According to the present invention, the timing at which the conveyance of a previous sheet bundle in the downstream direction is started is determined according to sheet information of the next sheet bundle. When the sheet bundle is discharged while the leading end thereof hangs down in the substantially vertical direction, the smooth stacking operation of the next sheet bundle stacked onto the previous sheet bundle is enabled. Therefore, the sheet bundle is reliably stacked in imbricated state without being bent.

Further features of the present invention will become apparent from the following description of exemplary embodiments with reference to the attached drawings.

DESCRIPTION OF THE EMBODIMENTS

An embodiment of the present invention will be described below in detail with reference to the drawings.

Figure 1:
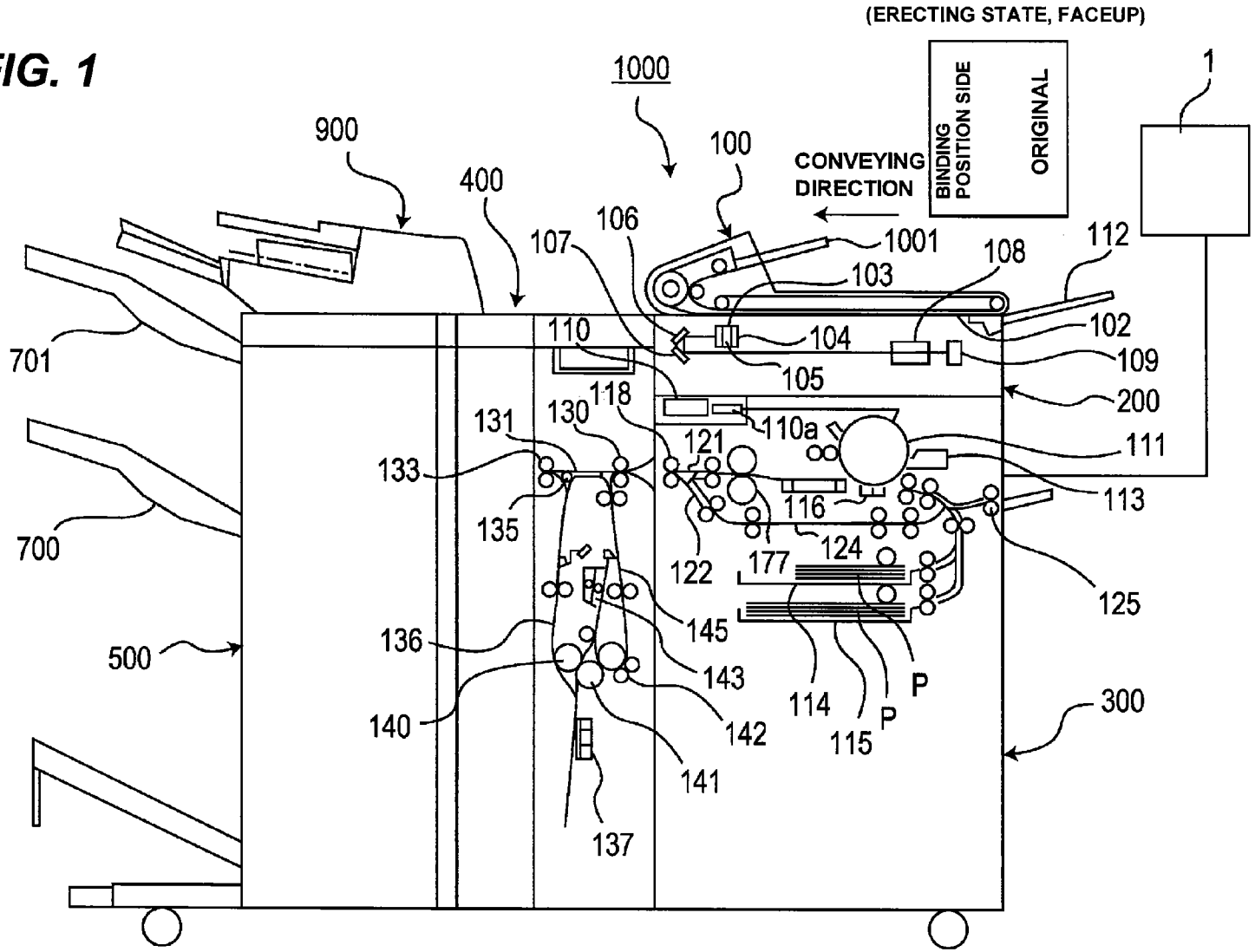
FIG. 1 is a cross-sectional view of an image forming apparatus according to an embodiment of the present invention.
Figure 2:
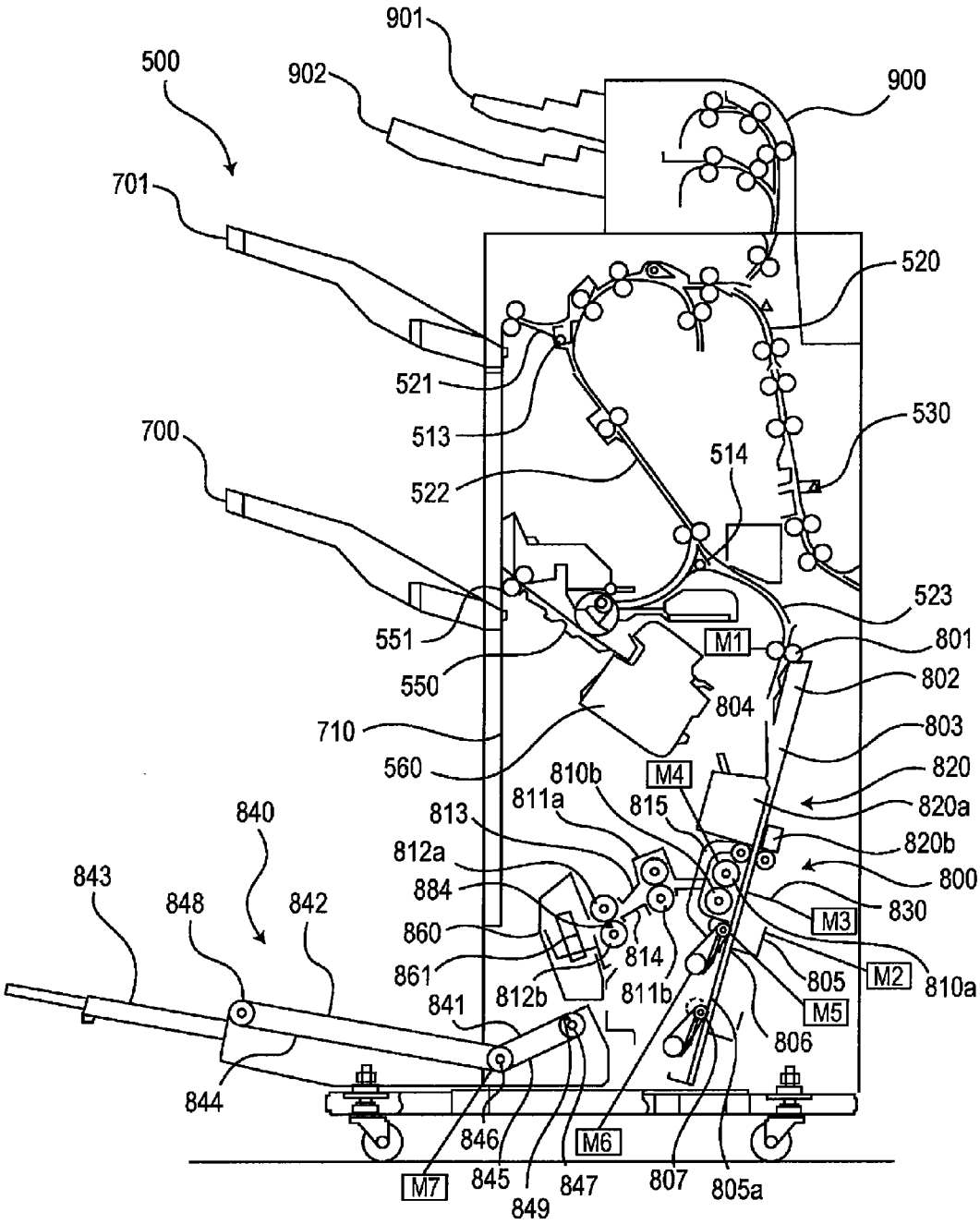
FIG. 2 is a cross-sectional view of a sheet post-processing apparatus illustrated in FIG. 1.

FIG. 1 is a schematic sectional view illustrating the schematic configuration of an image forming apparatus having a sheet post-processing apparatus. FIG. 2 is a schematic sectional view illustrating the schematic configuration of the sheet post-processing apparatus.

A copying machine is illustrated as the image forming apparatus. The dimensions, materials, shapes, and the relative arrangements of components described in the following embodiment should be appropriately changed according to the configuration of the apparatus and various conditions to which the present invention is applied. Accordingly, unless otherwise specified, the scope of the present invention is not limited to only them.

(Image Forming Apparatus)

In FIGS. 1 and 2, an image forming apparatus 1000 has an original feeding portion 100, an image reader portion 200, a printer portion 300, a folding process portion 400, a sheet post-processing apparatus 500 including a saddle stitch binding portion 800, and an inserter 900.

The folding process portion 400, the saddle stitch binding portion 800, and the inserter 900 can be equipped as an option. Originals are set on a tray 1001 of the original feeding portion 100 in erecting state seen from the user and in faceup state (in the state that the image-formed sides face up). The binding position of each of the originals is located at the left end of the original.

The originals set on the tray 1001 are sequentially conveyed by the original feeding portion 100 in page order in the left direction (in the arrow direction in the drawing), that is, with the binding position set to the leading position. The original passes through a curved path so as to be conveyed on a platen glass 102 from left to right and is then discharged onto a discharge tray 112. A scanner unit 104 is stopped in a predetermined original reading position.

The scanner unit 104 reads the image of the original while the original passes on the scanner unit 104 from left to right. Such original reading method is called original scanning. When the original passes on the platen glass 102, the original is irradiated by a lamp 103 of the scanner unit 104. A reflection light from the original is guided to an image sensor 109 via mirrors 105, 106, and 107, and a lens 108.

The original conveyed by the original feeding portion 100 is stopped once on the platen glass 102. In that state, the scanner unit 104 is moved from left to right so that the image of the original can be read. This reading method is called original fixation reading.

When the original is read without using the original feeding portion 100, the user lifts the original feeding portion 100 to set the original on the platen glass 102. In this case, the original fixation reading is performed.

The predetermined imaging process is performed for image data of the original read by the image sensor 109 and the image data is then transmitted to an exposure controlling portion 110. The exposure controlling portion 110 outputs a laser beam according to an image signal. The laser beam irradiates a photosensitive drum 111 while being scanned by a polygon mirror 110*a*. An electrostatic latent image according to the scanned laser beam is formed on the photosensitive drum 111.

The electrostatic latent image formed on the photosensitive drum 111 is developed by a development device 113 and is then made visual as a toner image. A sheet P is conveyed to a transfer portion 116 from any one of sheet cassettes 114 and 115, a manual feeding portion 125, and a duplex conveying path 124.

The visible toner image is transferred onto the sheet P by the transfer portion 116. The transferred toner image is fixed to the sheet P by a fixing portion 177. The photosensitive drum 111 and the development device 113 configure an image forming portion.

The sheet P which has passed through the fixing portion 177 is guided to a path 122 once by a switching member 121. When the trailing end of the sheet P passes through the switching member 121, the sheet P is switched back and is then conveyed and guided to a discharge roller 118 by the switching member 121.

The sheet P is discharged from the printer portion 300 by the discharge roller 118. Accordingly, the sheet P is discharged from the printer portion 300 in the state that the side formed with the toner image faces down. These operations will be called reverse discharge.

As described above, the facedown sheets P are discharged to the outside of the apparatus so that the image forming process can be sequentially performed for the sheets P in page order. The pages can be ordered when the image forming process is performed using the original feeding portion 100 and the image forming process is performed for an image data from a computer.

When the image forming process are performed for both sides of the sheet P, the sheet P is guided directly from the fixing portion 177 to the discharge roller 118. Immediately after the trailing end of the sheet P passes through the switching member 121, the sheet P is switched back and conveyed and is then guided to a duplex conveying path 124 by the switching member 121.

(Folding Process Portion)

The configurations of the folding process portion 400 and the sheet post-processing apparatus 500 will be described. The folding process portion 400 has a conveying path 131 which receives the sheet P discharged from the printer portion 300 to guide it to the sheet post-processing apparatus 500. A pair of conveying rollers 130 and a pair of discharge rollers 133 are provided on the conveying path 131.

A switching member 135 provided near the pair of discharge rollers 133 guides the sheet P conveyed by the pair of conveying rollers 130 to a folding path 136 or the sheet post-processing apparatus 500.

When the folding process is performed for the sheet P, the switching member 135 is switched to the folding path 136 to guide the sheet P to the folding path 136. The leading end of the sheet P conveyed to the folding path 136 is abutted onto a stopper 137 to form a loop. The sheet P is then folded by folding rollers 140 and 141.

The loop formed by the abutment of the folding portion onto the above stopper 143 is folded by the folding rollers 141 and 142 so that the sheet P is folded in Z shape. The sheet P folded in Z shape is guided through the conveying paths 145 and 131 and is then discharged to the sheet post-processing apparatus 500 by the pair of discharge rollers 133. The folding process operation of the folding process portion 400 is selectively performed.

When the folding process is not performed, the switching member 135 is switched to the side guiding the sheet P to the sheet post-processing apparatus 500. The sheet P discharged from the printer portion 300 passes through the conveying path 131 and the switching member 135 and is directly conveyed to the sheet post-processing apparatus 500.

(Sheet Post-Processing Apparatus)

The sheet post-processing apparatus 500 aligns the plurality of sheets P conveyed from the printer portion 300 via the folding process portion 400 and processes the sheets P.

To process the sheets P, there are the process bundling the sheets P into one sheet bundle, a stapling process (binding process) stapling the trailing end of the sheet bundle, the sort process, and the non-sort process. The processes of the sheets P are selectively performed.

As illustrated in FIG. 2, the sheet post-processing apparatus 500 has a conveying path 520 which takes the sheets P conveyed via the folding process portion 400 into the apparatus. The conveying path 520 has a plurality of pairs of conveying rollers.

A punch unit 530 is provided midway the conveying path 520. The punch unit 530 is operated, if necessary, and punches the trailing ends of the sheets P conveyed (the punch process is performed).

A switching member 513 is provided at the termination of the conveying path 520. The switching member 513 is switched between an upper discharge path 521 and a lower discharge path 522 connected to downstream. The upper discharge path 521 guides the sheets P to an upper stack tray 701.

A plurality of pairs of conveying rollers are provided on the lower discharge path 522. The pairs of conveying rollers convey and discharge the sheets P onto a processing tray 550.

The aligning process are sequentially performed for the sheets P discharged onto the processing tray 550 and the sheets P are stacked in a bundle. The sort process and the stapling process are selectively performed according to the setting from an operation portion 1 (see FIG. 1). The processed sheet bundle is selectively discharged onto the stack tray 700 or 701 by a pair of sheet bundle discharge rollers 551.

The stapling process is performed by a stapler 560. The stapler 560 is moved in the width direction (the direction orthogonal to the sheet conveying direction) of the sheets P and binds the sheet bundle in an arbitrary location.

The stack trays 700 and 701 are 1 if ted and lowered along the body of the sheet post-processing apparatus 500. The upper stack tray 701 receives the sheets P from the upper discharge path 521 and the processing tray 550.

The lower stack tray 700 receives the sheets P from the processing tray 550. A large quantity of the sheets P are stacked onto the stack trays 700 and 701. The trailing ends of the stacked sheets P are received and aligned by a trailing end guide 710 extended vertically.

A switching member 514 is provided midway the lower discharge path 522. The switching member 514 guides the sheets P to the processing tray 550 or a saddle discharge path 523. The sheets P guided to the saddle discharge path 523 by the switching member 514 are conveyed to the saddle stitch binding portion 800.

(Saddle Stitch Binding Portion)

The configuration of the saddle stitch binding portion 800 will be described. The sheets P conveyed to the saddle stitch binding portion 800 are received by a pair of saddle inlet rollers 801. The conveying inlet is selected by a switching member 802 operated by a solenoid according to size. The sheets P are conveyed into a storage guide 803 as a sheet stacking portion.

The downstream side in the conveying direction of the sheets P of the storage guide 803 is inclined so as to be lower than the upstream side. The conveyed sheets P continue to be conveyed by a sliding roller 804 and are then received by a first conveying roller 806 and a second conveying roller 807 provided together on the downstream side.

The sliding roller 804 is a roller having a low friction coefficient and slidability like a sponge roller. The first conveying roller 806 and the second conveying roller 807 have slidability like the sliding roller 804. The first conveying roller 806 and the second conveying roller 807 are a sheet bundle retaining portion which can be moved between an abutting position (indicated by a solid line) retaining the sheets P to the storage guide 803 and a retracting position (indicated by a dashed line) releasing the retaining of the sheet P.

The pair of saddle inlet rollers 801 and the sliding roller 804 are driven by an inlet roller motor M1. The first conveying roller 806 and the second conveying roller 807 are driven by a conveying roller motor M6.

The sheets P conveyed to the storage guide 803 are conveyed until the downstream ends thereof in the conveying direction are abutted onto an end stopper 805 as a sheet positioning member moved to a predetermined position according to sheet size (the length in the conveying direction of the sheets P).

The end stopper 805 can be moved in the sheet conveying direction along a sheet guide surface in which the downstream side in the sheet conveying direction of the storage guide 803 is inclined so as to be lower than the upstream side. The end stopper 805 is driven by an end stopper moving motor M2 so as to be moved in the conveying direction of the sheets P.

The end stopper 805 has a regulating surface 805*a* protruded from the storage guide 803 and receives and holds the ends on downstream in the conveying direction of the sheets P conveyed to the storage guide 803 by the regulating surface 805*a*. The end stopper 805 receives the sheet P in a first receiving position or a second receiving position at an interval in a predetermined range on downstream of the first feeding roller 806 or the second feeding roller 807.

The first receiving position is the solid line position indicated in FIG. 2 and is the receiving position on downstream of the first feeding roller 806 at a predetermined interval so that the sheets P are not bent. The second receiving position is the dashed line position indicated in FIG. 2 and is the receiving position on downstream of the second feeding roller 807 by the same interval. The predetermined range herein is the range in which the sheets P are not bent upon the reception of the conveying force of the feeding roller after the sheets P are abutted onto the regulating surface 805*a*.

The degree of easily bending (flexing) the sheets P is in proportion to the length in the conveying direction of the sheets P. Therefore, the receiving position of the end stopper 805 is preferably shorter in the predetermined range. The predetermined range is set to 15 to 30 mm, which is different according to the rigidity (grammage) of the sheets P and the conveying force of the conveying roller.

This value is determined by an experiment. The present invention is not limited to the above value. When the previously stored sheet P is bent, it blocks the conveying path of the sheet P to be stored next, causing sheet jamming. The predetermined range is set in the range in which no sheet jamming is caused.

A stapler 820 includes a driver 820*a* and an anvil 820*b* provided midway the storage guide 803 so that they are on opposite sides of the storage guide 803. The stapler 820 is a binding unit which binds the center portion in the conveying direction of the sheet bundle including the plurality of sheets P stored in the storage guide 803.

The stapler 820 is divided into the driver 820*a* which protrudes a staple and the anvil 820*b* which folds the protruded staple and, at the completion of the storing of the sheets P, staples the center portion in the conveying direction of the sheet bundle including the sheets P.

In the receiving position of the sheet ends received by the end stopper 805, the moving distance to the stapling position (or the folding position) is preferably shorter, which can shorten the processing time, or from the viewpoint of the stability of the sheet bundle conveyance.

The length from the sheet ends to the positions to be processed on the sheets P is a length L/2 of half of a length L in the conveying direction of the sheets P to be conveyed. The later-described controlling portion judges which of a first interval (length) L1 from the stapling position to the regulating surface in the first receiving position or a second interval (length) L2 from the stapling position to the regulating surface in the second receiving position is closer to the length L/2 of half of the length L in the conveying direction of the sheets P conveyed.

The receiving position of the end stopper 805 in which the length to the stapling position is closer to the length L/2 of the sheets P is selected.

On downstream of the stapler 820, a pair of folding rollers 810*a* and 810*b* and a pushout member 830 are provided on opposite sides of the storage guide 803. The pair of folding rollers 810*a* and 810*b* and the pushout member 830 are a folding portion which folds the sheet bundle stored in the storage guide 803 into two along the center portion in the conveying direction.

The pushout member 830 has a position retracted from the storage guide 803 as a home posit ion, and is protruded toward the center portion in the conveying direction of the sheet bundle stored in the storage guide 803 by the driving of a pushout motor M3.

While the sheet bundle is pushed into the nip between the pair of folding rollers 810*a* and 810*b*, the sheet bundle is folded into two along the center portion thereof. After the sheet bundle is pushed out, the pushout member 830 is returned to the home position. A pressure F1 which is enough to fold the sheet bundle is provided by a spring (not illustrated) between the pair of folding rollers 810*a* and 810*b*.

The folded sheet bundle is discharged onto a folded sheet bundle discharge tray via a pair of first folding conveying rollers 811*a* and 811*b* and a pair of second folding conveying rollers 812*a* and 812*b*. Pressures F2 and F3 which are enough to convey and stop the folded sheet bundle are provided to the pair of first folding conveying rollers 811*a* and 811*b* and the pair of second folding conveying rollers 812*a* and 812*b*, respectively. The pair of folding rollers 810*a* and 810*b*, the first folding conveying rollers 811*a* and 811*b*, and the second folding conveying rollers 812*a* and 812*b* are rotated at an equal speed by the same folding conveying motor M4.

When the sheet bundle is folded without performing the binding process, the sheet bundle is moved so that the center portion in the conveying direction of the sheet bundle stored in the storage guide 803 is located in the nip position between the pair of folding rollers 810*a* and 810*b*.

When the sheet bundle bound by the stapler 820 is folded, the sheet bundle located in the stapling position is moved after the completion of the stapling process so that the stapling position (or the center portion in the conveying direction) of the sheet bundle is the nip position between the pair of folding rollers 810*a* and 810*b*. The sheet bundle can be folded in the position performed the stapling process.

The sheet bundle is moved from the sheet storing position (or each of the receiving positions) to the stapling position and from the stapling position to the folding position by lowering or lifting the end stopper 805 by the motor M2.

A pair of aligning plates 815 each having a surface protruded to the storage guide 803 while moving around the outer circumferential surfaces of the pair of folding rollers 810*a* and 810*b* are provided in the positions of the pair of folding rollers 810*a* and 810*b*. The pair of aligning plates 815 are moved in the width direction orthogonal to the conveying direction of the sheets P upon the driving of an aligning plate moving motor M5 to align (or position) the sheets P stored in the storage guide 803 in the width direction.

On downstream of the pair of second folding conveying rollers 812*a* and 812*b* as a discharge portion, a press unit 860 as a folded end process portion which performs the folded end process strengthening the fold of the folded end of the sheet bundle is provided. A folded sheet bundle tray 840 as a stacking portion which stacks the sheet bundle performed the folded end process is provided on downstream of the press unit 860.

In the upper portion of the sheet post-processing apparatus 500, there is provided the inserter 900 which inserts a sheet (or an insert sheet) different from the typical sheet P, as the top page, the last page, or the intermediate page, into the sheets P formed with images by the printer portion 300.

(Press Unit)

Figure 3:
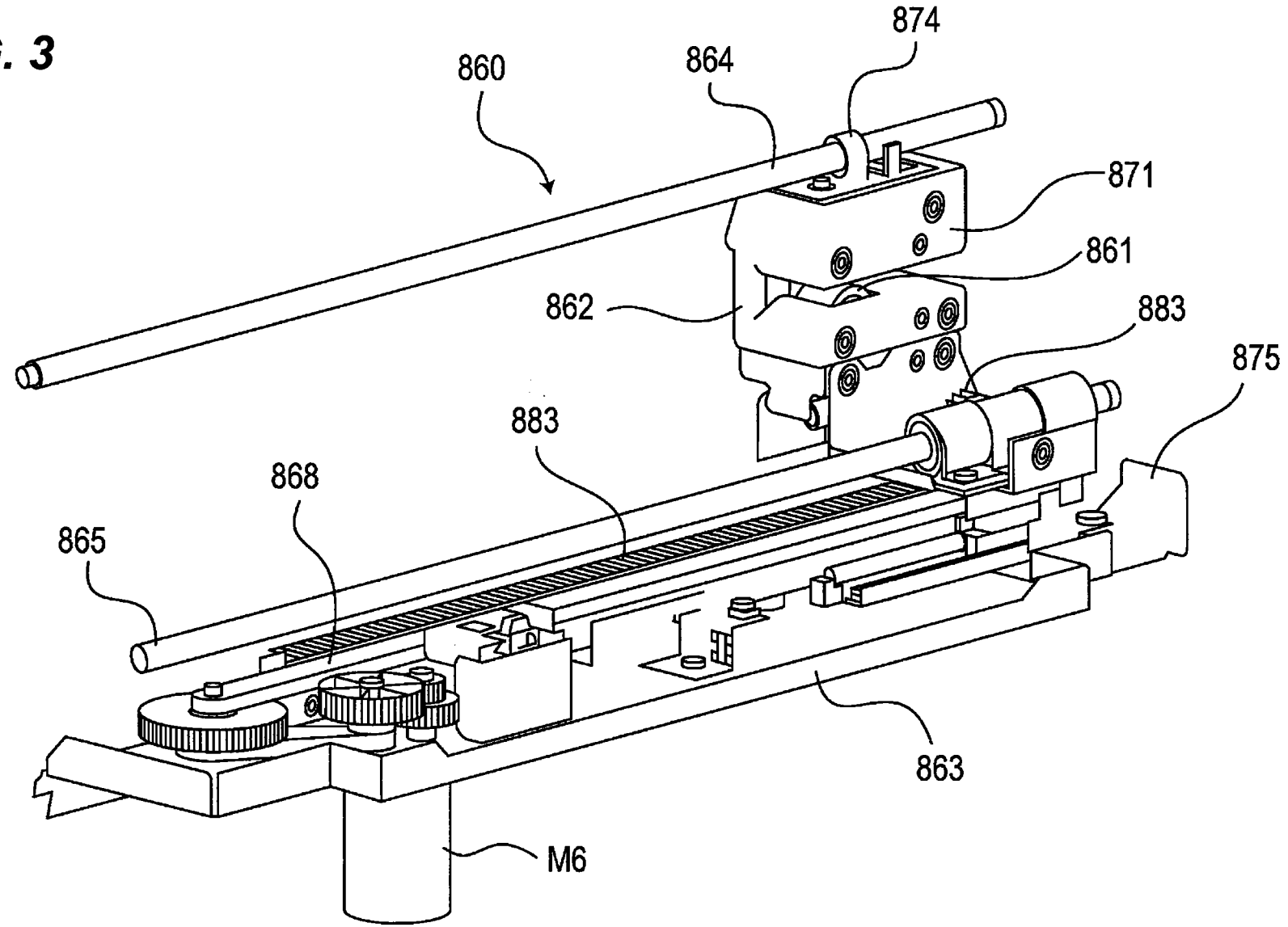
FIG. 3 is a perspective view of a press unit illustrated in FIG. 2.
Figure 4:
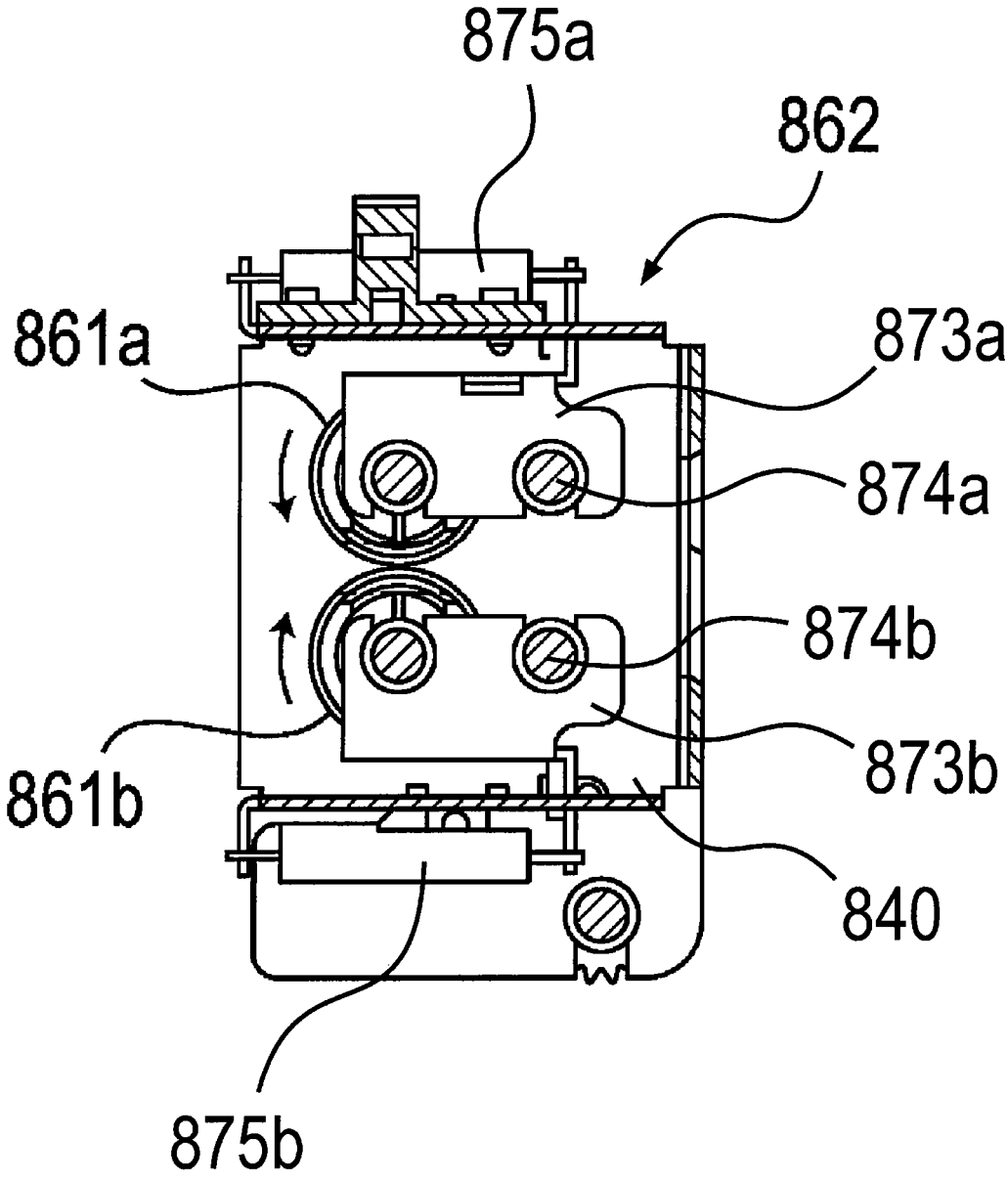
FIG. 4 is an explanatory view of the inside of the press unit illustrated in FIG. 2.

The press unit 860 will be described with reference to FIGS. 3 and 4. FIG. 3 is a perspective view of the press unit. FIG. 4 is an explanatory view of the inside of the press unit.

As illustrated in FIG. 3, the press unit 860 has a base sheet metal 863 incorporating a main portion and two slide shafts 864 and 865 and is fixed to the front and rear side plates. The two slide shafts 864 and 865 are provided in parallel with each other so as to extend in the sheet width direction orthogonal to the discharge direction of the sheet bundle. The slide shafts 864 and 865 penetrate through slide bearings 874 and 875 fixed to a press holder 862 to support the press holder 862. A pair of press rollers 861 as the folded end process portion are rotatably attached to the press holder 862 and a sheet guide 871 with respect to the pair of press rollers 861 are attached thereto.

As illustrated in FIG. 4, press arms 873*a* and 873*b* are swingably supported by swing shafts 874*a* and 874*b* via bearings. Each of tension springs 875*a* and 875*b* are engaged with one end of each of the press arms 873*a* and 873*b*. A pair of press rollers 861*a* and 861*b* have a pressure in the direction closing to each other for nipping. When the sheet bundle is inserted into the pair of press rollers 861*a* and 861*b*, the press arms 873*a* and 873*b* are rotated with the swinging shafts 874*a* and 874*b* as a fulcrum and the rollers are separated.

A gear 883 illustrated in FIG. 3 is engaged with a rack gear extended in parallel with the slide shafts 864 and 865 and fixed to the base sheet metal 863. When a press motor M8 is rotated, the press holder 862 is moved by being supported by the slide shafts 864 and 865 with the movement of a timing belt 868.

At the movement, the gear 883 of the press holder 862 is engaged with the rack gear and is rotated. The driving is transmitted to a pair of press rollers 861*a* and 861*b* coupled to the gear 883 by gear trains. The gear trains are set so that the moving speed of the press holder 862 is equal to the circumferential speed of the pair of press rollers 861*a* and 861*b*.

When the folded end strengthening process by the pair of press rollers 861 is performed for the folded end of the sheet bundle folded by the pair of folding rollers 810*a* and 810*b*, the sheet bundle is held by two or more pairs of rollers regardless of processed size.

So the sheet bundle held in this manner when the folded end process is performed for the sheet bundle, the sheet bundle is not shifted due to the movement of the pair of press rollers 861. The leading end stop position (the press leading end position) of the sheet bundle for the folded end process is controlled using a sheet bundle discharge sensor 884 provided in a sheet bundle conveying guide 814 so that the relative relation between it and the pair of press rollers 861 is constant regardless of size. The leading end stop position is determined based on the result in which the sheet bundle discharge sensor 884 detects the leading end of the sheet bundle for which the folded end process to be performed.

The sheet bundle trailing end position (the press trailing end position) for the folded end process is regulated by the storage guide 803. The arrangement of each portion is determined so that the trailing end is not opened. The arrangement of each portion is determined so that the press trailing end position is outside the region of the storage guide 803.

While the folded end strengthening process is performed for the sheet bundle by the pair of press rollers 861, the storing operation of the sheets P forming the next sheet bundle in the storage guide 803 and the aligning operation of them are enabled. This contributes to the improvement of the productivity of the apparatus.

Sheet bundle conveying guides 813 and 814, including the press holder 862, are arranged so as to be accommodated between the storage guide 803 and the trailing end guide. This enables the spatial overlapped arrangement of the folded sheet bundle tray 840 and the press unit 860 and reduces the size of the apparatus in the conveying direction.

(Folded Sheet Bundle Tray)

A first stacking surface 841, a second stacking surface 842, and a third stacking surface 843 of the folded sheet bundle tray 840 are successively provided so as to be continuous in the discharge direction of the sheet bundle. They stack the sheet bundle discharged from the pair of second folding conveying rollers 812*a* and 812*b*.

The first stacking surface 841 is located below the press unit 860. The space in the vertical direction of the first stacking surface 841 is partially overlapped with the press unit 860. The downstream side in the discharge direction of the first stacking surface 841 is inclined downward. The inclining angle is substantially equal to the discharge angle of the sheet bundle of the pair of second folding conveying rollers 812*a* and 812*b*. The top point of inclination is located in the highest position up to the height not interfering with the operation of the press unit 860.

A first conveyor belt 845 and a second conveyor belt 844 as a moving portion moving the discharged sheet bundle to downstream or upstream in the sheet bundle discharge direction are provided to the first stacking surface 841 and the second stacking surface 842.

One end of each of the conveyor belts 844 and 845 is entrained on a driving pulley 846 near the bent portion. The other end of the first conveyor belt 845 is entrained about an idler pulley 847 so as to be in parallel with the stacking surface. The other end of the second conveyor belt 844 is entrained about an idler pulley 848 so as to be in parallel with the stacking surface. The conveyor belts 844 and 845 are normally and reversely rotated in the same direction upon the driving of a conveyor motor M7 coupled to the shaft of the driving pulley 846.

A sheet bundle detection sensor 849 which can detect the sheet bundle stacked immediately below the operating region of the press unit 860 is provided on the first stacking surface 841. The stacking position of the discharged sheet bundle is controlled based on a detection signal.

(Inserter)

The inserter 900 feeds the sheets P set on insert trays 901 and 902 by the user to any of the stack trays 701 and 700 and the folded sheet bundle tray 840 without passing through the printer portion 300. The sheets of the sheet bundle stacked onto the insert trays 901 and 902 are sequentially separated one by one and join the conveying path 520 at a predetermined timing.

(Controlling Portion)

Figure 5:
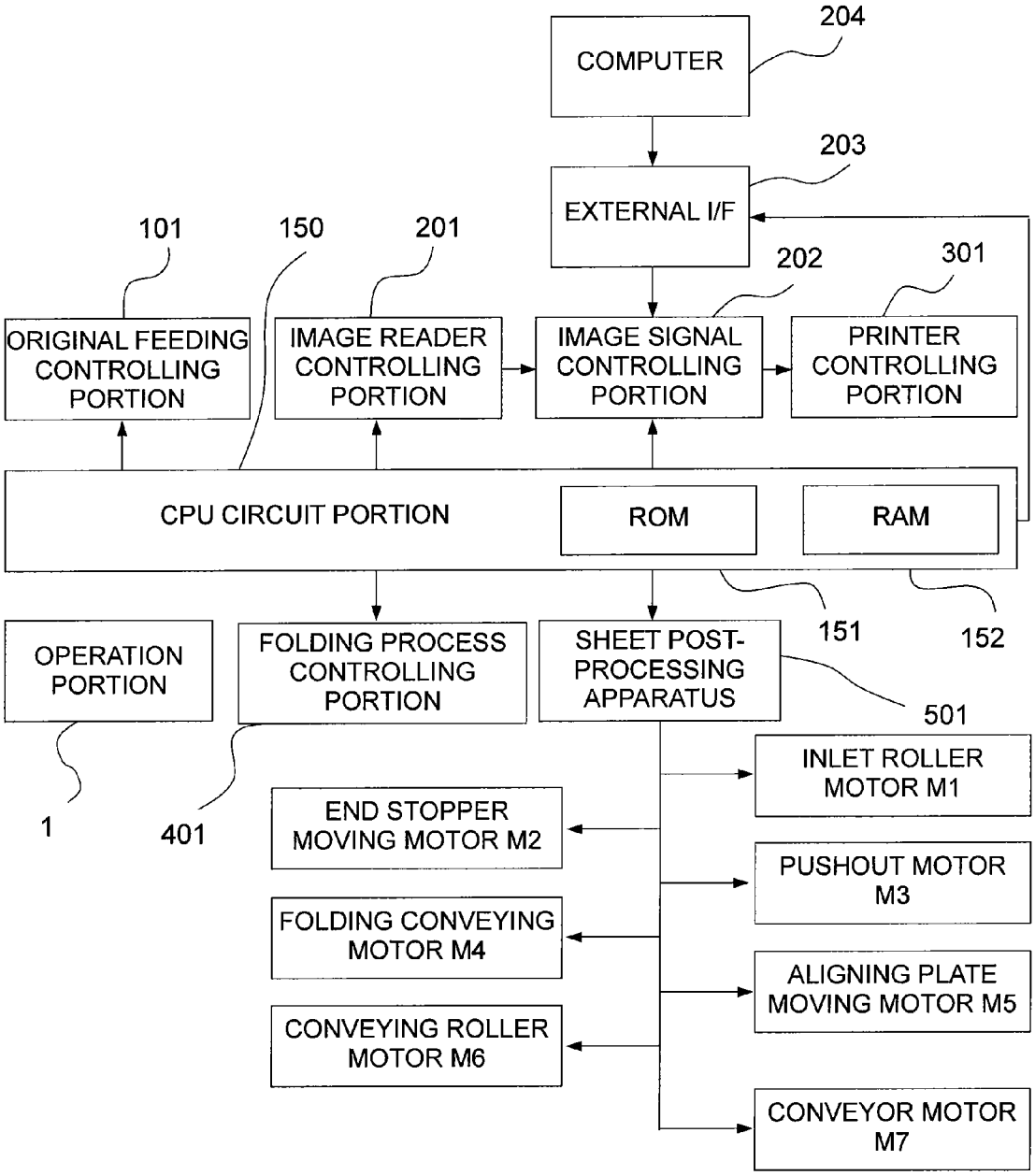
FIG. 5 is a block diagram illustrating the configuration of the control system of the image forming apparatus of FIG. 1.

The control system of the image forming apparatus 1000 will be described with reference to FIG. 5. FIG. 5 is a block diagram illustrating the configuration of the control system of the image forming apparatus 1000. A CPU circuit portion 150 is provided in the printer portion 300 and has a CPU, a ROM 151, and a RAM 152.

The CPU circuit portion 150 controls an original feeding controlling portion 101, an image reader controlling portion 201, and an image signal controlling portion 202 according to the setting of a control program stored in the ROM 151 and the operation portion 1. The CPU circuit portion 150 also controls a printer controlling portion 301, a folding process controlling portion 401, a sheet post-processing apparatus controlling portion 501, and an external I/F (external interface) 203.

The original feeding controlling portion 101 controls the original feeding portion 100. The image reader controlling portion 201 controls the image reader portion 200. The printer controlling portion 301 controls the printer portion 300. The folding process controlling portion 401 controls the folding process portion 400.

The sheet post-processing apparatus controlling portion 501 controls the sheet post-processing apparatus 500 including the saddle stitch binding portion 800 and the inserter 900. In particular, the driving of the motors M1 to M8 of the saddle stitch binding portion 800 is controlled by the sheet post-processing apparatus controlling portion 501.

The operation portion 1 has a plurality of keys which set various functions about image formation and a displaying portion which displays a set state. The operation portion 1 outputs a key signal corresponding to the operation of each of the keys by the user to the CPU circuit portion 150, and displays the corresponding information based on a signal from the CPU circuit portion 150 on the displaying portion.

The RAM 152 is used as an area which temporarily holds control data and an operating area of computation with control. The external I/F 203 is an interface between the image forming apparatus 1000 and an external computer 204, and develops print data from the computer 204 to a bitmap image to output it as image data to the image signal controlling portion 202.

The image of the original read by the image sensor 109 is output from the image reader controlling portion 201 to the image signal controlling portion 202. The printer controlling portion 301 outputs the image data from the image signal controlling portion 202 to the exposure controlling portion 110.

The configuration in which the sheet post-processing apparatus controlling portion 501 is mounted on the sheet post-processing apparatus 500 has been described here. The sheet post-processing controlling portion 501 may be provided in the printer portion 300 so as to be integral with the CPU circuit portion 150. The sheet post-processing apparatus 500 may be controlled from the printer portion 300.

(Bookbinding Discharge Operation)

The operation of each portion in the saddle stitch binding discharge will be described with the flow of the sheets P. When the saddle stitch binding mode is set by the user, the appropriately page-ordered and image-formed sheets P are sequentially discharged from the discharge roller 118 of the printer portion 300.

The sheets P pass through the folding process portion 400 so as to be received by the pair of inlet rollers and then pass through the conveying path 520 to enter into the lower discharge path 522. The sheets P are then guided to the saddle discharge path 523 by the switching member 514 midway the lower discharge path 522.

Figure 6:
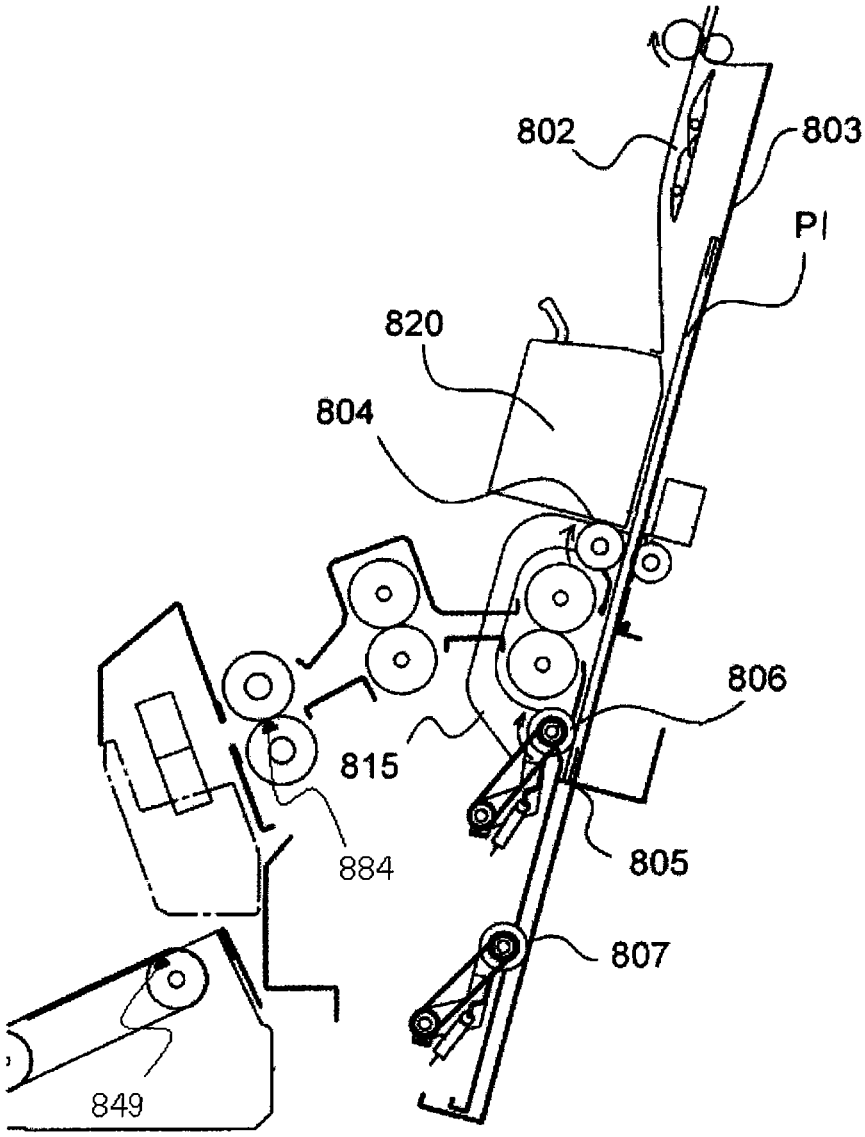
FIG. 6 is a cross-sectional view illustrating the operation of a saddle stitch binding portion illustrated in FIG. 2.

As illustrated in FIG. 6, the sheets P are discharged to the storage guide 803 while being guided by the switching member 802 according to the size of the sheets P. The sheets P receive the conveying force of the sliding roller 804, the first feeding roller 806, or the second feeding roller 807, are abutted onto the end stopper 805 stopped in the position suitable for the sheet size, and are positioned in the conveying direction.

The nip aligning by the pair of aligning plates 815 on standby in the non-interfering position at sheet discharge is performed. The positioning in the sheet width direction is also performed. The sheet storing and aligning operations are performed when each of the sheets P is discharged.

Figure 7:
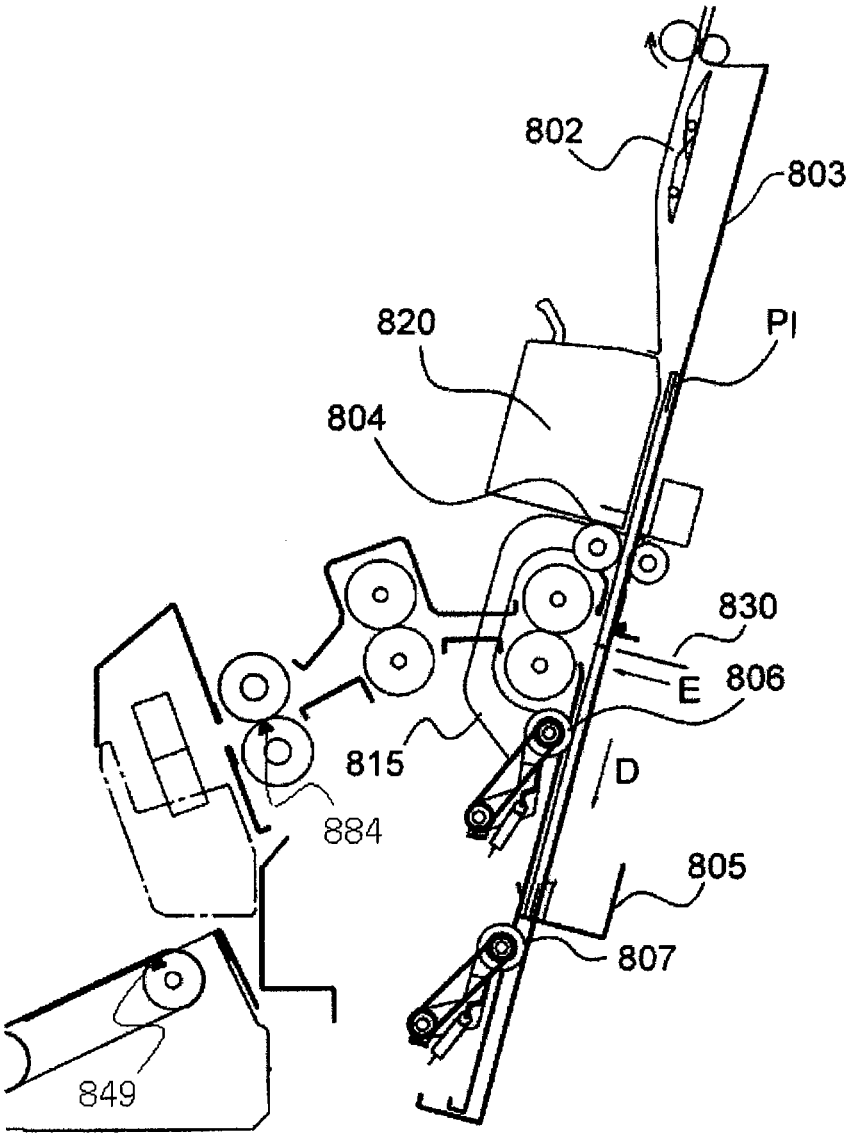
FIG. 7 is a cross-sectional view illustrating the operation of a saddle stitch binding portion illustrated in FIG. 2.

When the aligning of the last sheet P of the sheet bundle is completed, the stapler 820 staples the center portion in the conveying direction of the sheet bundle. As illustrated in FIG. 7, the sheet bundle P1 as the stapled previous folded sheet bundle is moved downward (in an arrow D direction) with the movement of the end stopper 805.

Figure 8:
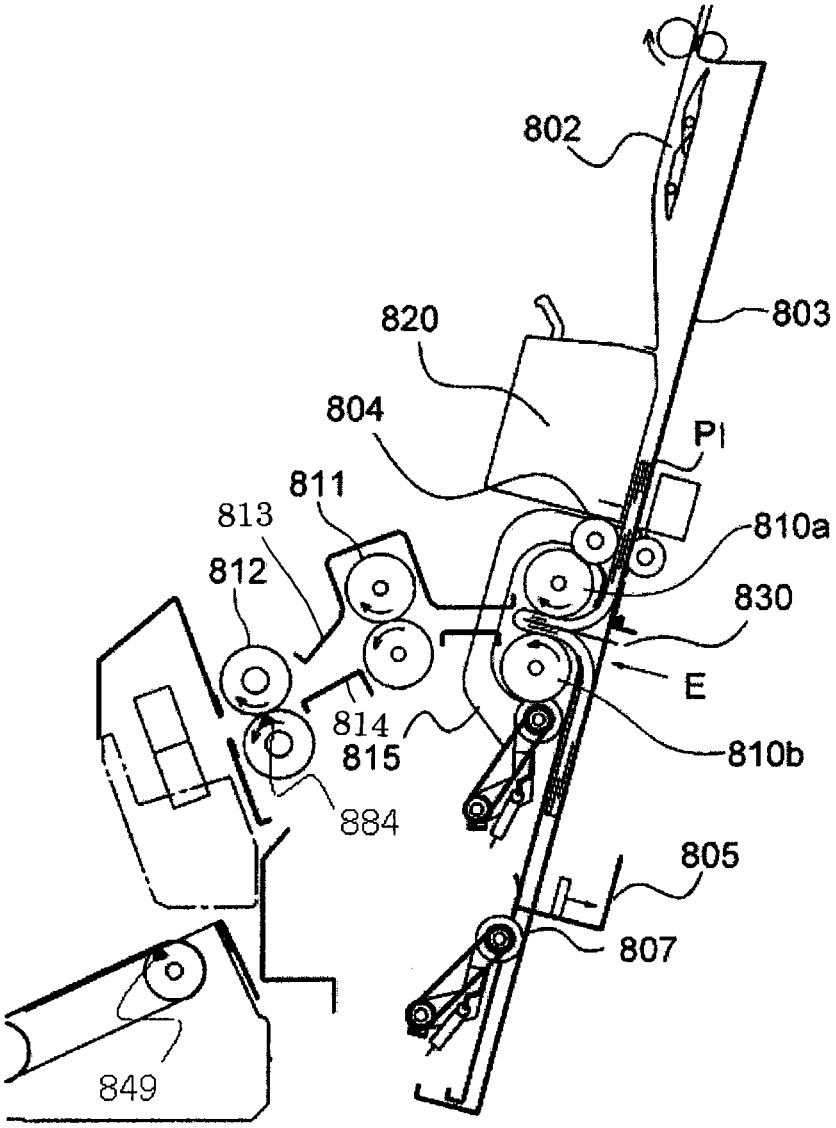
FIG. 8 is a cross-sectional view illustrating the operation of a saddle stitch binding portion illustrated in FIG. 2.

The end stopper 805 is stopped in the position where the center portion of the sheet bundle P1, that is, the stapling portion, corresponds to the nip between the pair of folding rollers 810. The pushout member 830 in the standby position starts to move to the nip between the pair of folding rollers 810 (in an arrow E direction). As illustrated in FIG. 8, the sheet bundle P1 is moved while the center portion thereof extends the distance between the pair of folding rollers 810 by force, and is inserted into the nip between the rollers and folded.

The pair of folding rollers 810 are driven by the motor M4 with the pair of first folding conveying rollers 811 (811*a* and 811*b*) and the pair of second folding conveying rollers 812 (812*a* and 812*b*) and are rotated in the arrow direction. The sheet bundle P1 is conveyed in the sheet bundle conveying guides 813 and 814 with the folded end set to the leading position.

Figure 9:
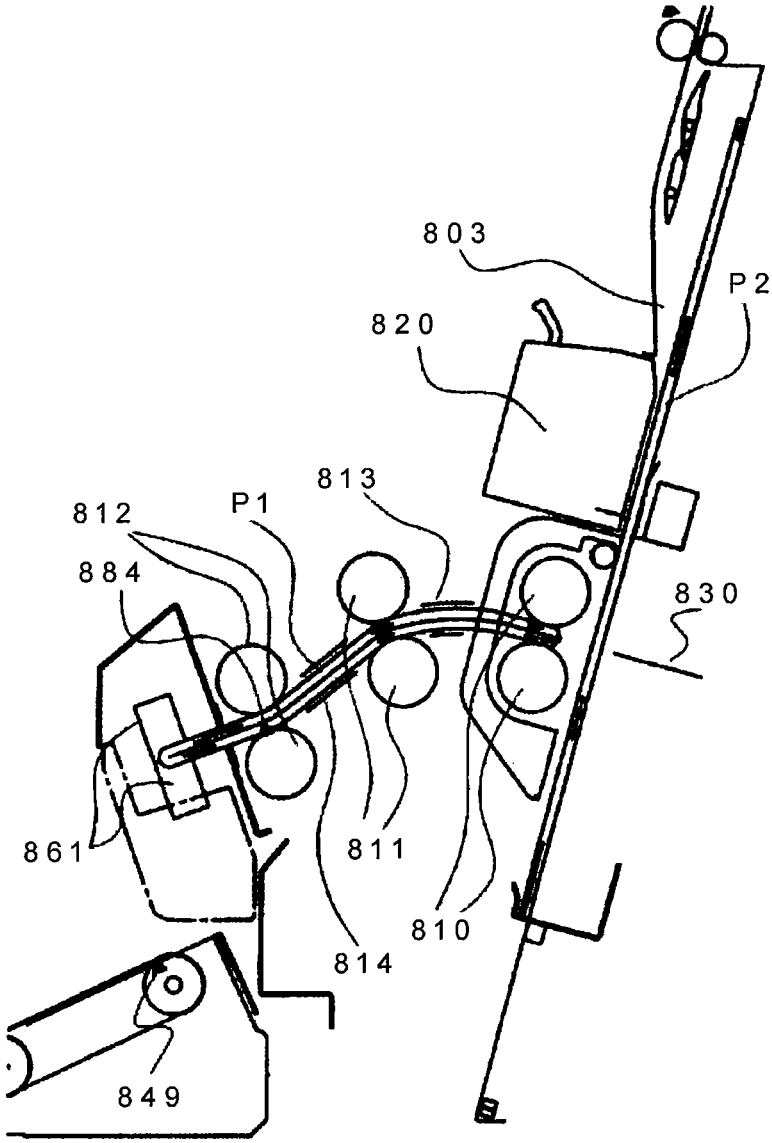
FIG. 9 is a cross-sectional view illustrating the operation of a saddle stitch binding portion illustrated in FIG. 2.

As illustrated in FIG. 9, when the sheet bundle is conveyed to the position where the folded end thereof is nipped between the pair of press rollers 861, it is stopped by the motor M4. The stop position control is performed so that the leading end of the sheet bundle P1 is detected by the sheet bundle discharge sensor 884.

The leading end on one of the opposite sides of the center in the conveying direction of the sheet bundle P1 is reliably held by the pair of second folding conveying rollers 812. The trailing end on the other of the opposite sides of the center in the conveying direction of the sheet bundle P1 is reliably held by the pair of first folding conveying rollers 811 or the pair of folding rollers 810 (810*a* and 810*b*) according to the size of the sheet bundle P1 (the length in the conveying direction). The pushout member 830 is moved to the retracting position again when the pushout is completed.

Figure 10:
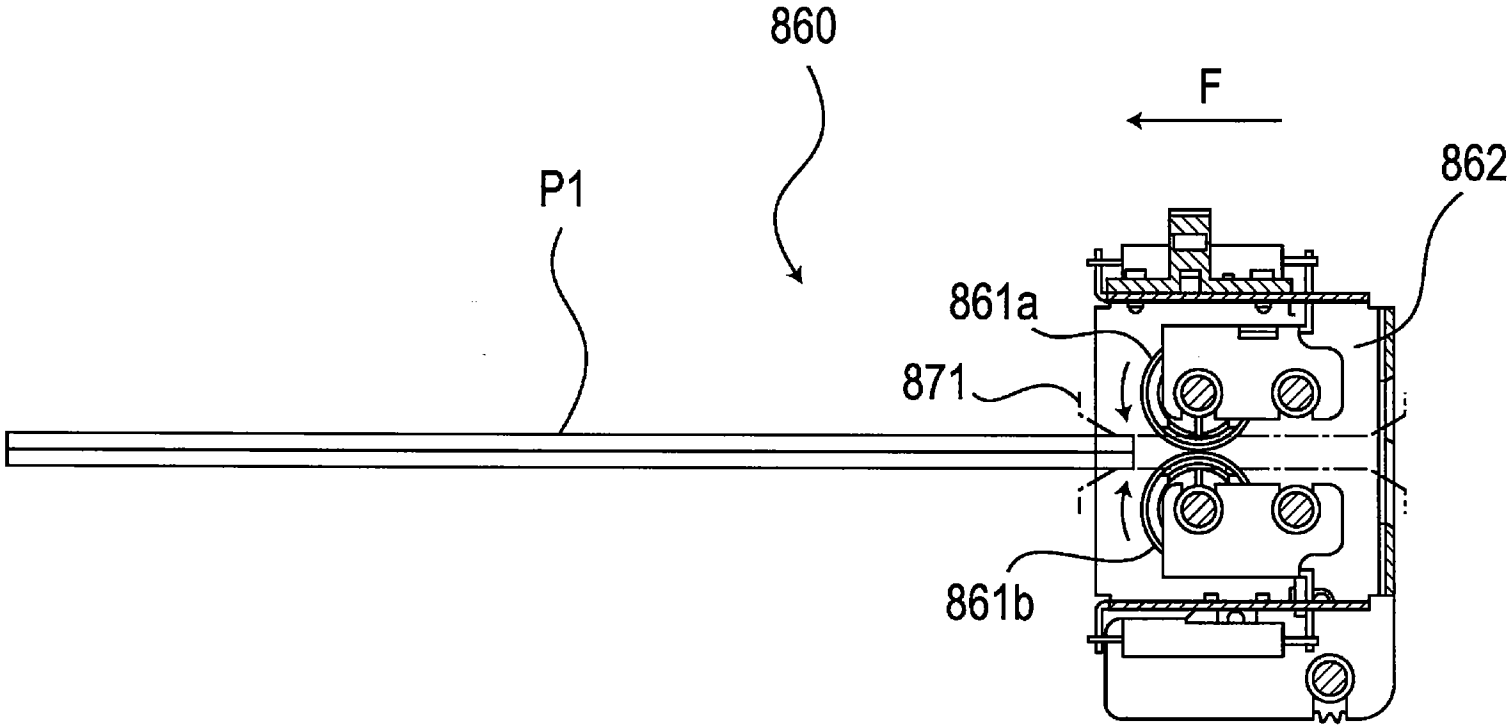
FIG. 10 is an explanatory view of the folded end process operation of the press unit of FIG. 3.

When the folded end process is performed, as illustrated in FIG. 10, prior to the conveyance of the sheet bundle P1, the press holder 862 is standby in the standby position (rear side) according to the size (in the width direction) of the sheet bundle P1.

When the stop of the sheet bundle P1 is completed and the folded end of the sheet bundle P1 is inserted into the sheet guide 871 (the chain line), the sheet bundle P1 is driven by the feeding roller motor M6. The pair of press rollers 861*a* and 861*b* are then rotated to start to move the sheet bundle P1 forward (in an arrow F direction).

Figure 11:
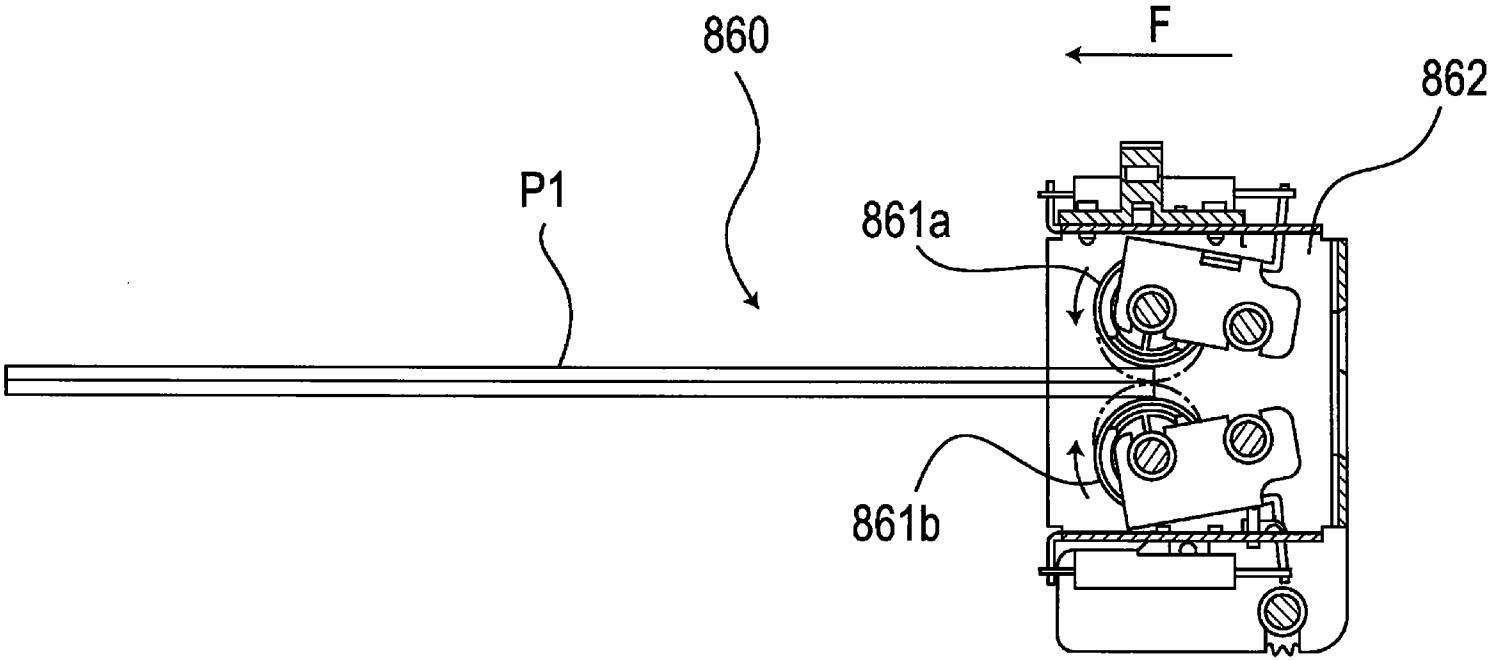
FIG. 11 is an explanatory view of the folded end process operation of the press unit of FIG. 3.

The pair of press rollers 861*a* and 861*b* are abutted onto the side surfaces near the folded end of the stopped and held sheet bundle P1. The pair of press rollers 861*a* and 861*b* themselves are rotated by the driving from both sides. As illustrated in FIG. 11, the pair of press rollers 861*a* and 861*b* smoothly move over the side surfaces of the sheet bundle P1 to nip the folded end thereof.

This effect is not changed even if the thickness of the sheet bundle P1 is increased. In synchronization with the movement of the press holder 862, the sheet bundle P1 can be nipped between the pair of press rollers 861*a* and 861*b* without response delay. No damage such as wrinkle, tear, and roller trace is given to the sheet bundle P1.

After the completion of the movement of the pair of press rollers 861, the press unit 860 is moved to the home position to open the path in the conveying direction of the sheet bundle P1. The conveyance of the sheet bundle P1 stopped by the motor M4 is started again. The sheet bundle P1 is discharged by the pair of second folding conveying rollers 812.

(The Conveying Operation of the Previous Sheet Bundle Stacked onto the Folded Sheet Bundle Tray)

Figure 16:
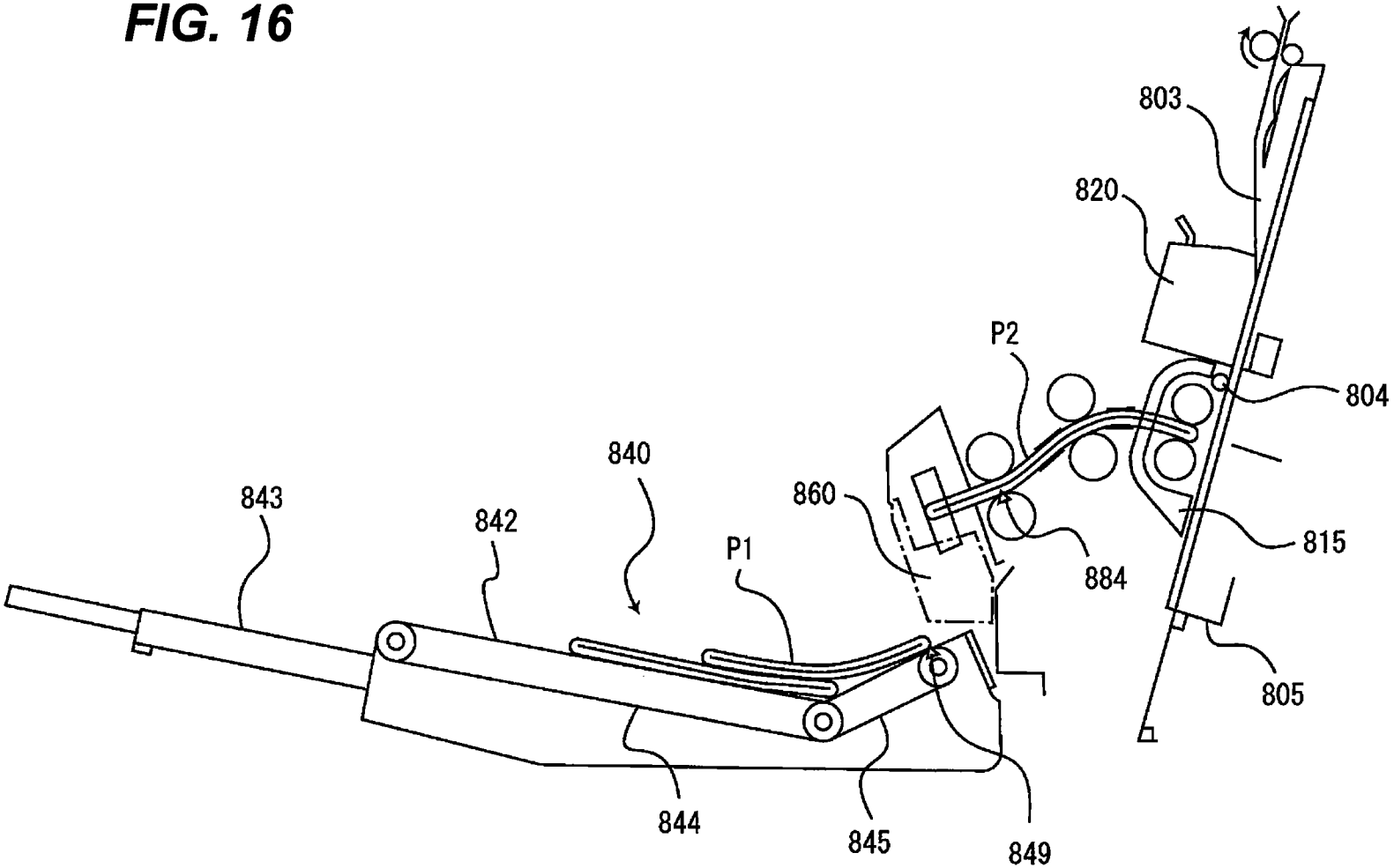
FIG. 16 is an explanatory view of the sheet bundle discharge operation of the press unit illustrated in FIG. 2.
Figure 17:
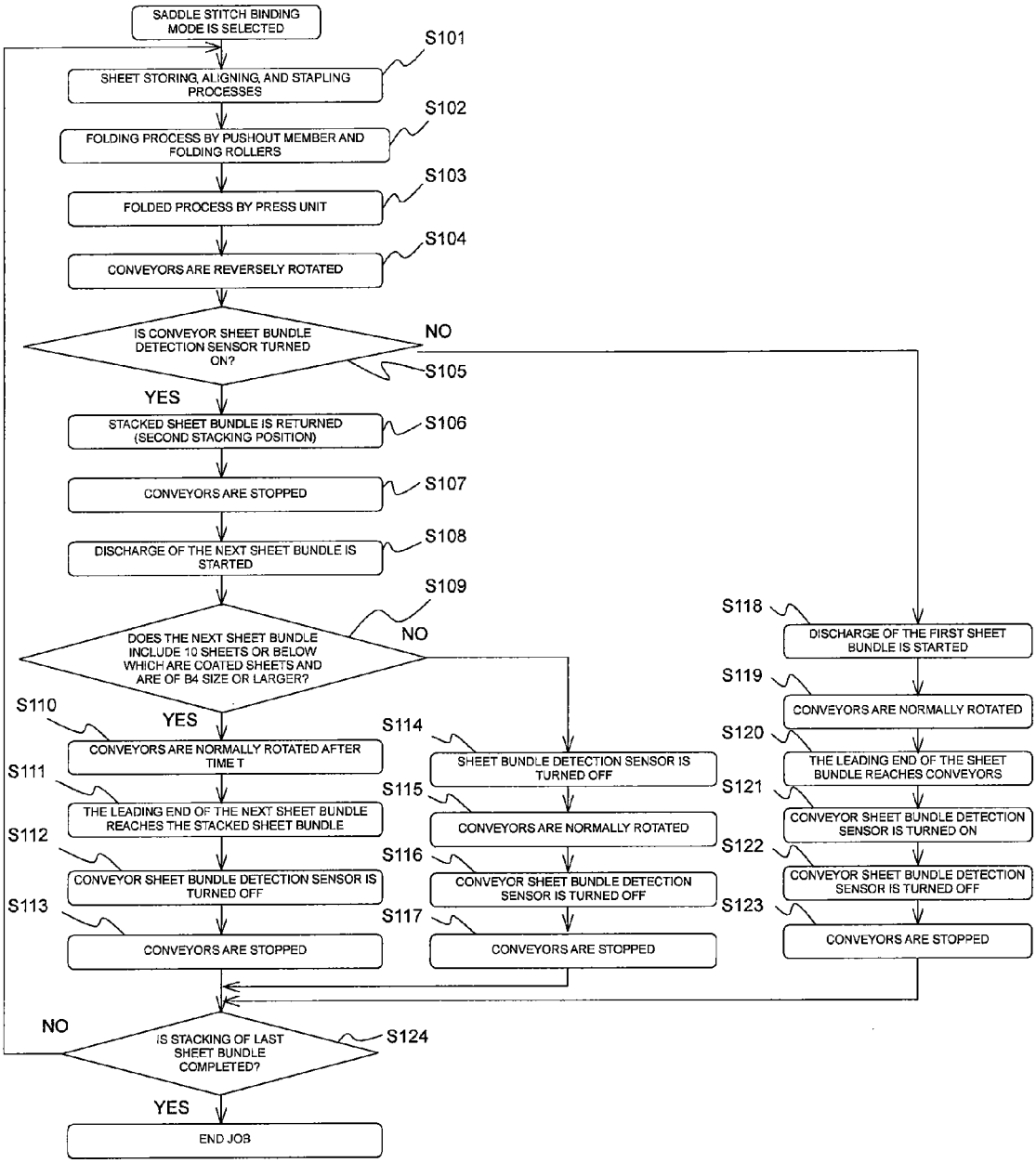
FIG. 17 is a flowchart illustrating the sheet bundle discharge operation of the press unit illustrated in FIG. 2.
Figure 18:
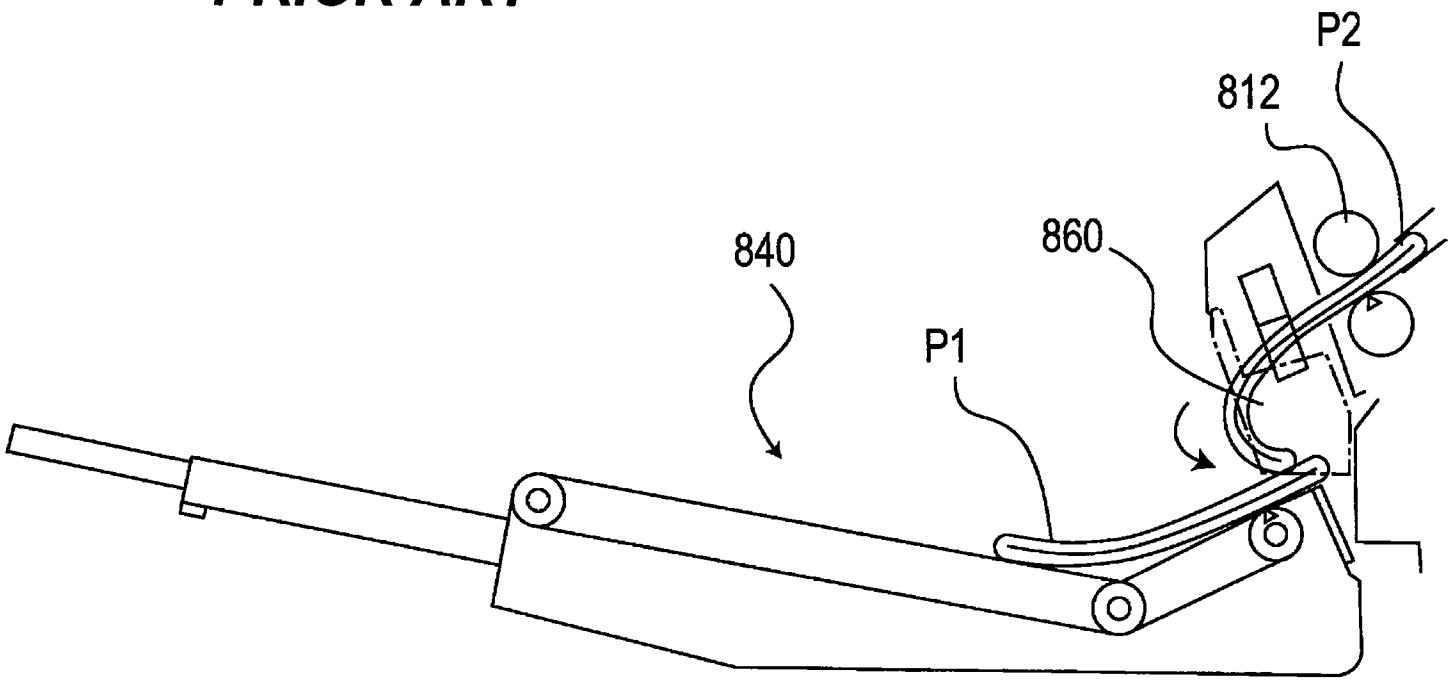
FIG. 18 PRIOR ART
FIG. 18 is an explanatory view of stacking failure at the time of the sheet bundle discharge operation of the related art.
Figure 19:
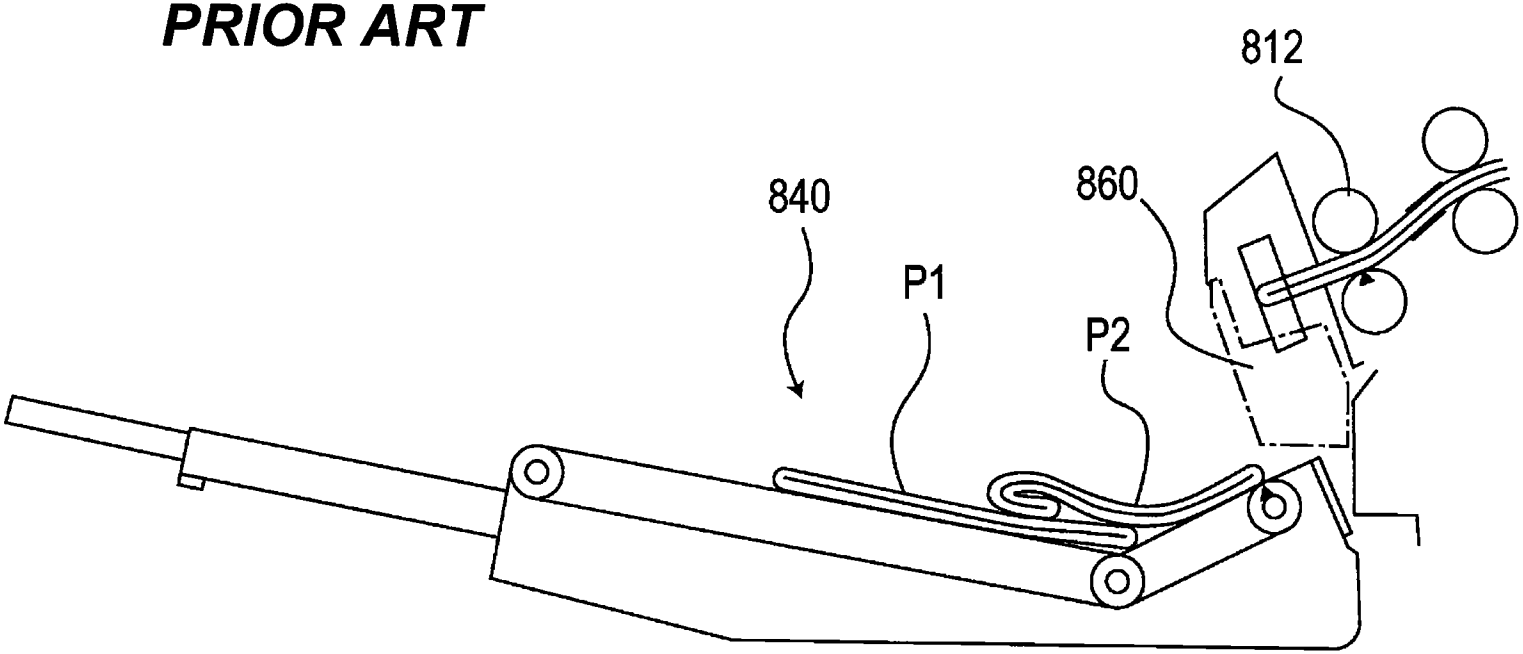
FIG. 19 PRIOR ART
FIG. 19 is an explanatory view of stacking failure at the time of the sheet bundle discharge operation of the related art.
Figure 20:
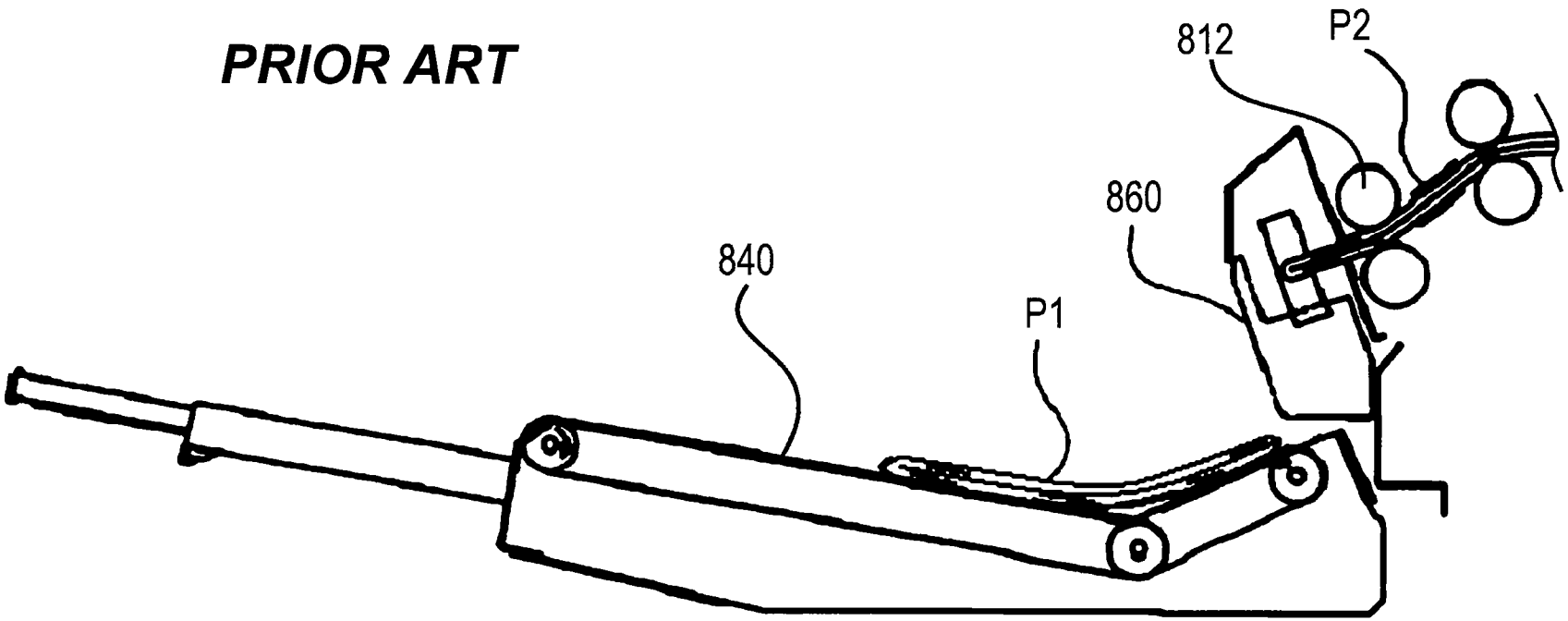
FIG. 20 PRIOR ART
FIG. 20 is an explanatory view of stacking failure at the time of the sheet bundle discharge operation of the related art.

The operation control of the sheet bundle P1 as the previous folded sheet bundle discharged and stacked onto the folded sheet bundle tray 840 when the sheet bundle P2 as the next folded sheet bundle is discharged will be described with reference to FIGS. 12 to 17. FIGS. 12 to 16 are explanatory views of the sheet bundle discharge operation. FIG. 17 is a flowchart illustrating the sheet bundle discharge operation.

The first conveyor belt 845 and the second conveyor belt 844 start to rotate in the conveying direction at a predetermined timing by the conveyor motor M7 and convey the sheet bundle P1 discharged onto the folded sheet bundle tray 840.

Figure 12:
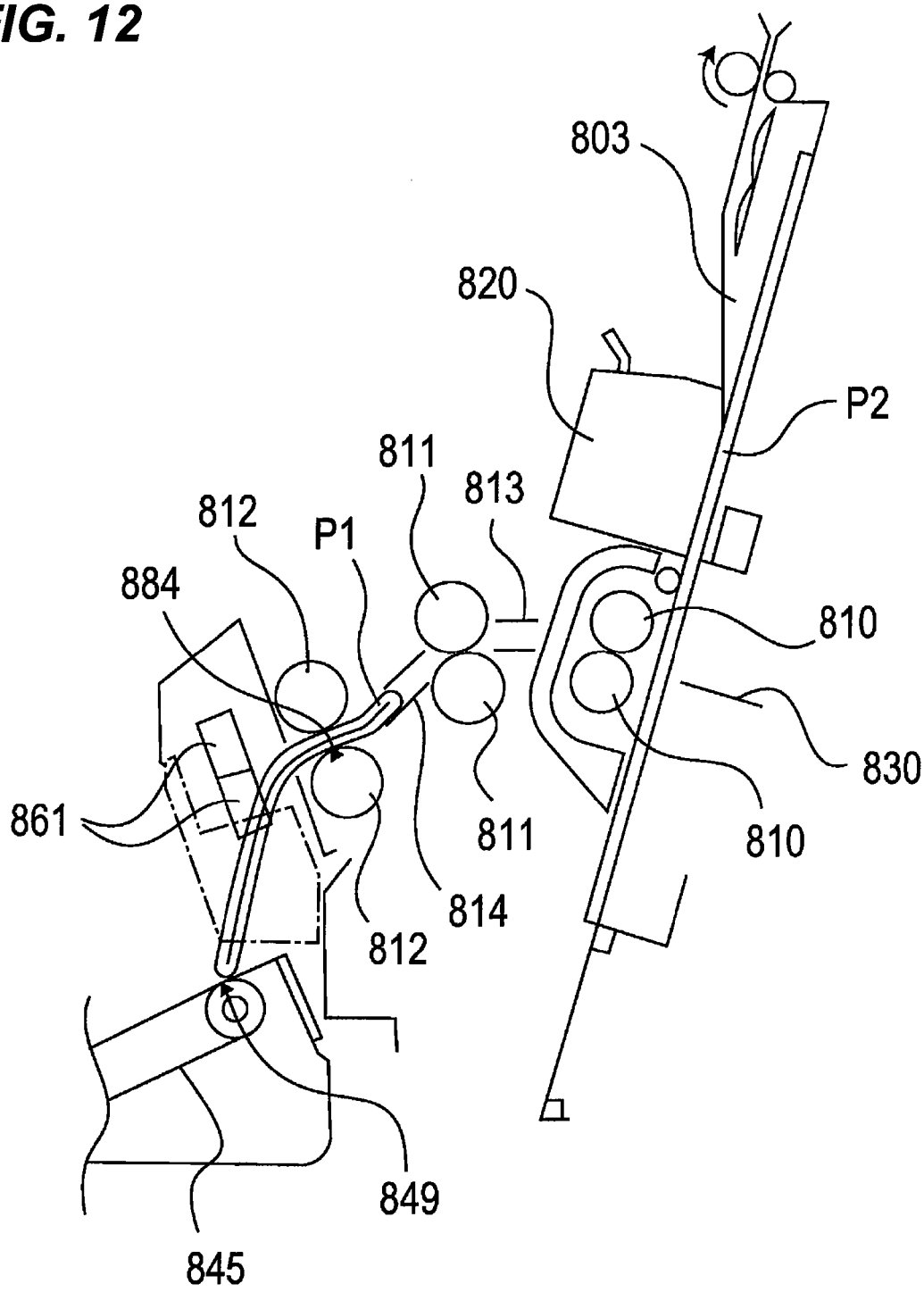
FIG. 12 is an explanatory view of the sheet bundle discharge operation of the press unit illustrated in FIG. 2.
Figure 13:
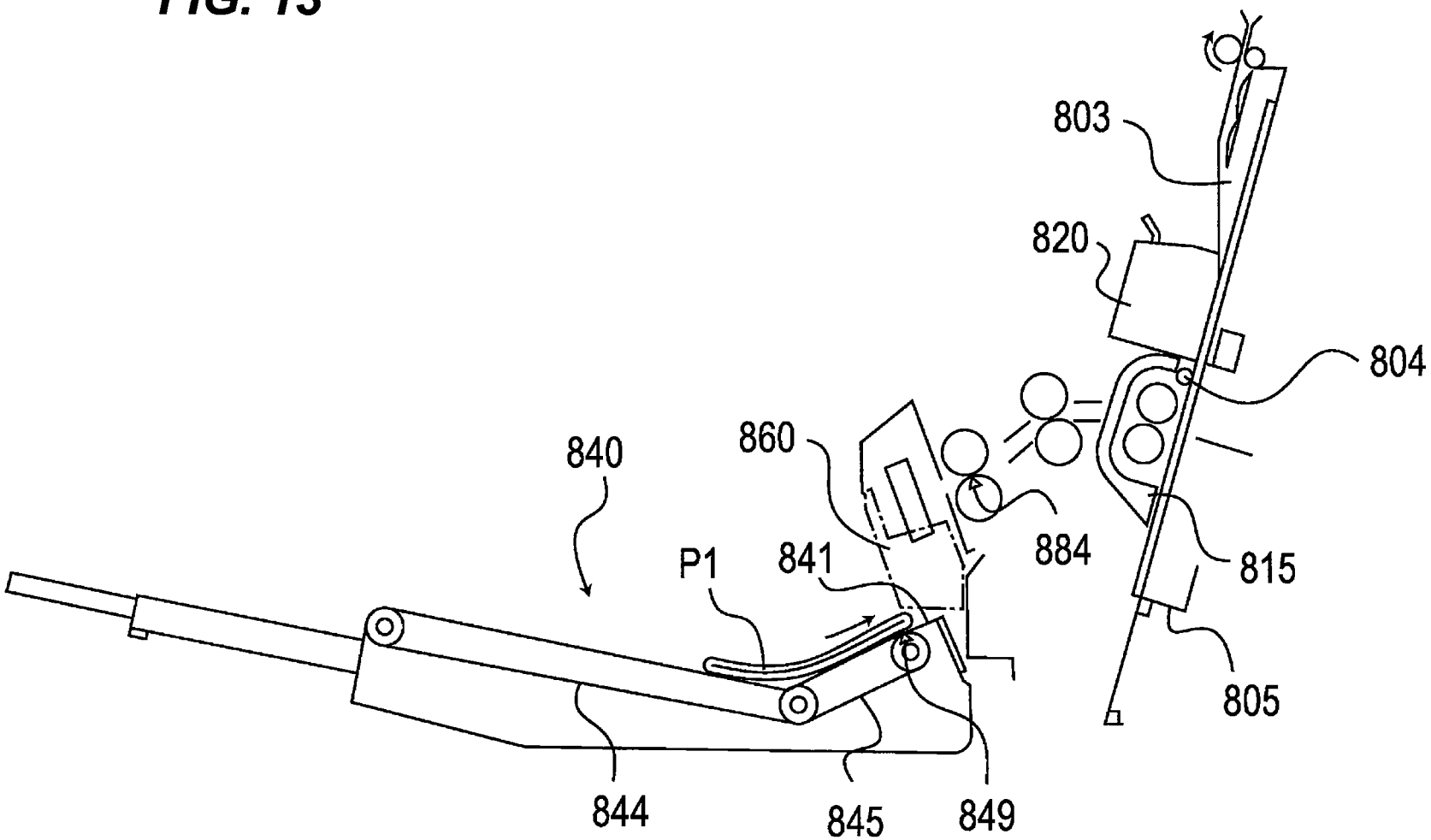
FIG. 13 is an explanatory view of the sheet bundle discharge operation of the press unit illustrated in FIG. 2.

As illustrated in FIG. 12, the downstream end (hereinafter, called the leading end) in the discharge direction of the sheet bundle P1 reaches the first conveyor belt 845. In FIG. 13, when the upstream end (hereinafter, called the trailing end) in the discharge direction of the sheet bundle P1 is detected by the sheet bundle detection sensor 849, the conveyor motor M7 is stopped (a first stacking position). The sheet bundle detection sensor 849 is disposed immediately below the operating region of the press unit 860. The trailing end of the stopped sheet bundle P1 is outside the operating region of the press unit 860.

The discharge and aligning operations of the next sheet bundle P2 are continued. The folded end process is also performed for the next sheet bundle P2 by the press unit 860.

The upstream end in the discharge direction of the sheet bundle P1 in the first stacking position is located on downstream in the discharge direction rather than the operating region of the press holder 862 of the press unit 860. The first stacking position is set to the position where the upstream end in the discharge direction of the sheet bundle P1 does not interfere with the press unit 860. Therefore, the discharged sheet bundle P1 does not interfere with the folded end process by the press unit 860.

Figure 14:
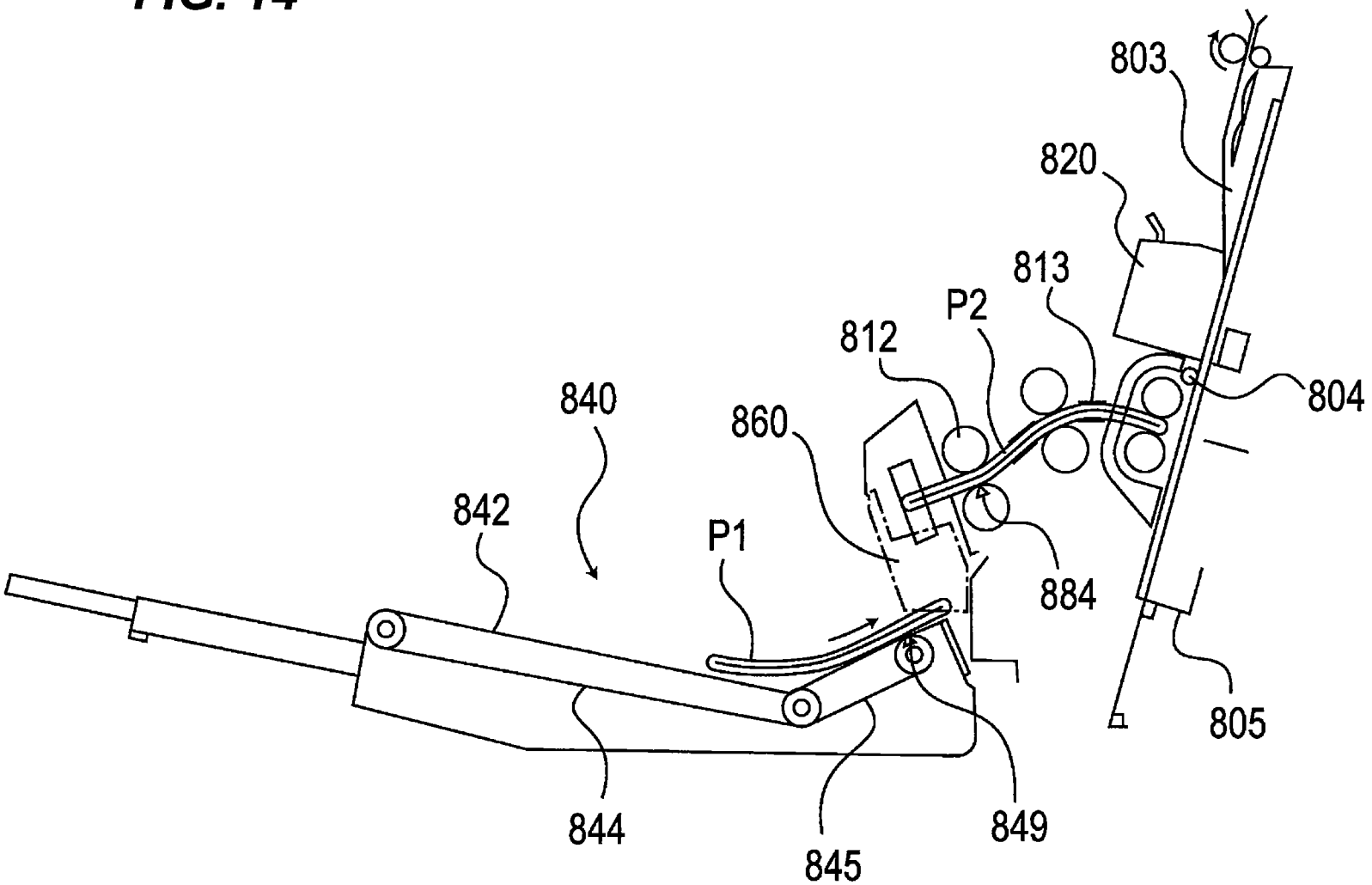
FIG. 14 is an explanatory view of the sheet bundle discharge operation of the press unit illustrated in FIG. 2.

As illustrated in FIG. 14, the folded end process of the next sheet bundle P2 is completed and the press unit 860 is moved to the home position. After the completion of the folded end process, the first conveyor belt 845 and the second conveyor belt 844 are driven by the conveyor motor M7 and are rotated in the opposite direction of the conveying direction of the sheet bundle P1. The sheet bundle P1 in the first stacking position is returned to the position close to the pair of second folding conveying rollers 812 (a second stacking position) on upstream of the first stacking position.

The amount of return is set so that the trailing end of the sheet bundle P1 in the second stacking position is located on upstream in the sheet discharge direction of the leading end position where the next sheet bundle P1 discharged by the pair of second folding conveying rollers 812 hangs down by its own weight and is discharged.

The hanging-down degree of the sheet bundle P2 by its own weight is different according to the type (rigidity, thickness, and size) of the sheet P. The amount of return is set according to sheet information from a sheet type discrimination portion which discriminates the type of the sheet P (the CPU circuit portion 150).

The sheet type discrimination portion discriminates the type of sheet by sheet information input by the user from the operation portion 1 as an input portion provided in the printer portion 300 or sheet information from the external computer 204.

The sheet type discrimination portion may employ other methods using information input by the user. The type of the sheet P may be automatically discriminated by sheet information from a detection portion, such as a sensor detecting sheet size and a sensor detecting grammage (thickness).

Figure 15:
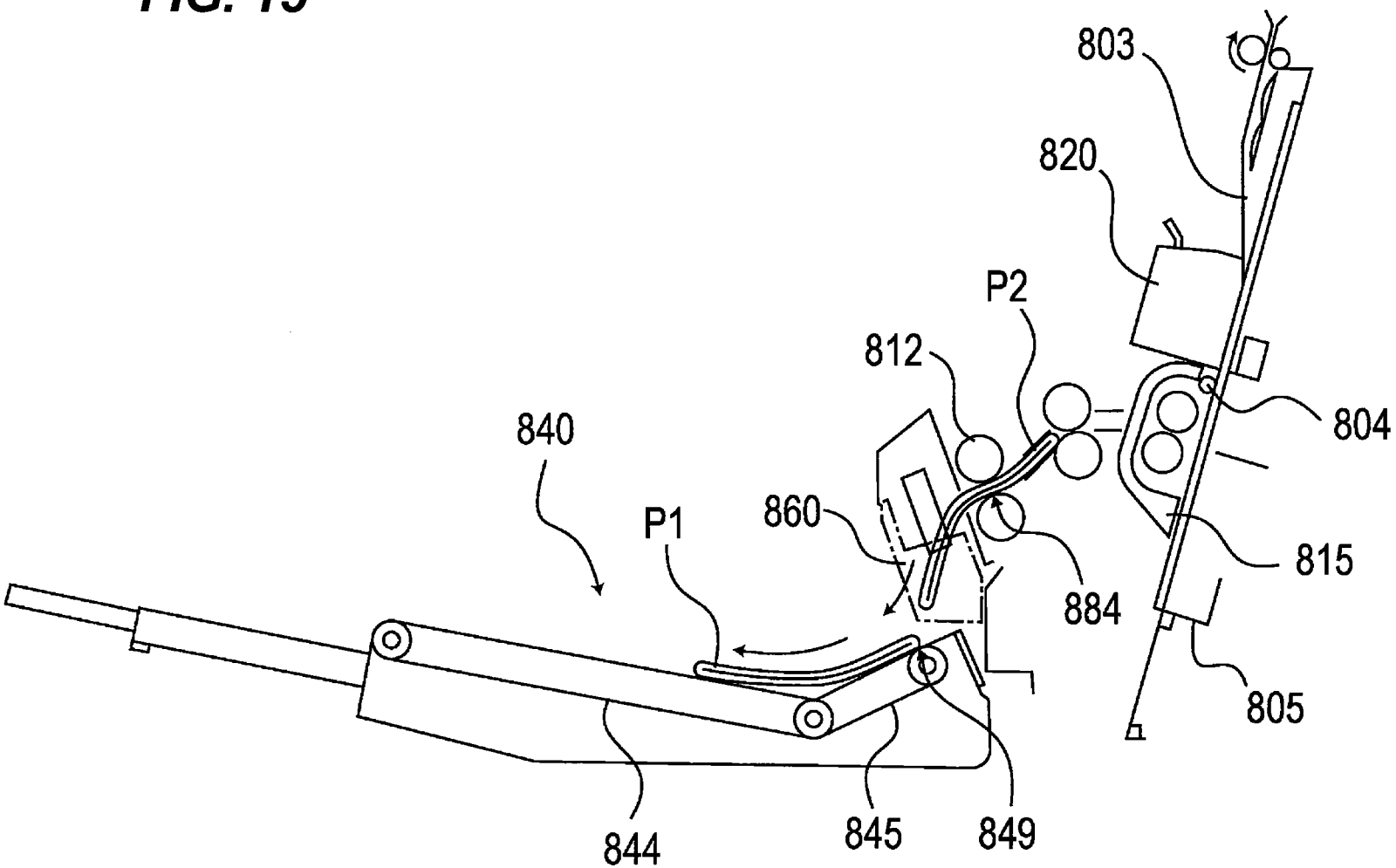
FIG. 15 is an explanatory view of the sheet bundle discharge operation of the press unit illustrated in FIG. 2.

As illustrated in FIG. 15, the sheet bundle P2 is discharged from the pair of second folding conveying rollers 812 to the folded sheet bundle tray 840 by the motor M4. After a predetermined time T from the discharge start of the sheet bundle P2, the first conveyor belt 845 and the second conveyor belt 844 are rotated to downstream in the conveying direction.

The predetermined time T is set to be shorter than a time Tp in which the leading end of the next sheet bundle P2 discharged by the pair of second folding conveying rollers 812 is abutted onto the previous sheet bundle P1 in the second stacking position. Moreover, the predetermined time T is set so that the trailing end of the sheet bundle P1 is located on upstream in the sheet discharge direction of the leading end position of the sheet bundle P2 when the leading end of the sheet bundle P2 is abutted onto the sheet bundle P1. Such predetermined time T is determined according to the second stacking position of the sheet bundle P1, a discharge speed V1 of the pair of second folding conveying rollers 812, and a conveying speed V2 of the conveyor belts 844 and 845.

The time Tp until the leading end of the sheet bundle P2 is abutted onto the sheet bundle P1 depends on the type of the sheet bundle and the number of sheets of the sheet bundle if the discharge speed V1 and the conveying speed V2 of the conveyor belts 844 and 845 are constant. Therefore, the maximum time of the predetermined time T is set based on sheet information.

In this embodiment, after the predetermined time T from the discharge start of the sheet bundle P2, the conveyor belts 844 and 845 are rotated to downstream in the conveying direction. Accordingly, when the leading end of the sheet bundle P2 is abutted onto the sheet bundle P1, the sheet bundle P1 starts to move to downstream in the conveying direction.

The stable discharging and stacking operations of the sheet bundle P2 can be performed in the state that the sheet bundle P2 is stacked so that the folded end thereof is overlapped with the upstream end in the discharge direction of the sheet bundle P1 in the second stacking position, or in so-called imbricated state. The leading end of the sheet bundle P2 abutted onto the sheet bundle P1 is moved and discharged to downstream in the conveying direction together with the sheet bundle P1. Therefore, the next sheet bundle including sheets which have low rigidity like coated sheets and hang down in the substantially vertical direction so as to be discharged, the bending and rounding of the next sheet bundle abutted onto the leading end of the previous sheet bundle can be prevented.

To prevent the bending of the sheet bundle after the abutment, the conveying speed V2 of the conveyor belts 844 and 845 is desirably equal to or higher than the discharge speed V1 of the pair of second folding conveying rollers 812. As illustrated in FIG. 16, when the trailing end of the sheet bundle P2 discharged onto the folded sheet bundle tray 840 is detected by the sheet bundle detection sensor 849, the sheet bundle P2 is stopped in the first stacking position. Accordingly, the press unit 860 is operated without any trouble.

The operation is repeated until the last bundle. A desired number of sheet bundles are orderly stacked onto the folded sheet bundle tray 840 in imbricated state.

The second stacking surface 842 is an inclined surface in which the downstream side in the sheet discharge direction thereof is upwardly of the upstream side in the vertical direction. When the number of sheet bundles stacked onto the folded sheet bundle tray 840 is increased, the discharged first sheet bundle P1 is conveyed so as to move over the inclination of the inclined second stacking surface 842 on the downstream side in the discharge direction.

Specifically, the sheet bundle P1 is conveyed with the folded end thereof set to the leading position. Therefore, the sheet bundle is conveyed on the inclined surface so that the trailing end thereof is hard to be opened, thereby enabling stable sheet bundle conveyance. When the number of stacked sheet bundles is increased, the sheet bundle P1 is conveyed onto the third stacking surface 843 with a step.

When sequentially stacked onto the folded sheet bundle tray 840, the sheet bundles are orderly stacked in imbricated state. Therefore, the conveyor belts 844 and 845 perform repeatedly normal rotation and reverse rotation and convey the sheet bundles.

The predetermined time T until the conveyor belts 844 and 845 are started is determined so as to maintain the imbricated state even when the sheet bundle passes through the second stacking surface 842 and the step portion when being conveyed onto the third stacking surface 843.

Specifically, the second stacking position of the stacked sheet bundle, the discharge speed V1 of the pair of second folding conveying rollers 812, and the conveying speed V2 of the conveyor belts 844 and 845 are assumed to be fixed without depending on the type of sheet. In this case, when the predetermined time T is long (or close to the time Tp until the leading end of the next sheet bundle is abutted onto the previous sheet bundle), the amount of overlap of the upstream end in the discharge direction of the sheet bundle P1 and the downstream end in the discharge direction of the sheet bundle P2 is increased.

When the sheet size is small and the number of sheets of the sheet bundle is increased, the open end of the folded sheet bundle is easily opened. In order that the previous folded sheet bundle is conveyed on the folded sheet bundle tray 840 while maintaining the imbricated state, the amount of overlap of the previous folded sheet bundle with the next folded sheet bundle need be increased.

Specifically, the amount of overlap of the upstream end in the discharge direction of the sheet bundle P1 and the downstream end in the discharge direction of the sheet bundle P2 need be set according to the type of sheet and the number of sheets of the sheet bundle. The predetermined time T until the conveyor belts 844 and 845 are started is set based on information on the type of sheet obtained by the input from the operation portion, thereby optimally setting the amount of overlap.

The sheet bundle discharge operation will be described by the flowchart of FIG. 17. When the saddle stitch binding mode is selected, the stapling process and the folding process of the sheet P are successively performed (steps S101 to S103) and the sheet bundle P1 is conveyed onto the folded sheet bundle tray 840.

The first conveyor belt 845 and the second conveyor belt 844 are reversely rotated (step S104). The sheet bundle P1 is returned in the opposite direction of the conveying direction (the second stacking position) (steps S105 and S106). The conveyor belts 844 and 845 are stopped (step S107).

The discharge operation of the next sheet bundle P2 is started (step S108). When the sheet bundle P2 is a sheet bundle including 10 sheets or below which are coated sheets having low sheet rigidity and are of B4 size or larger (step S109), the conveyor belts 844 and 845 are normally rotated after the time T from discharge start (step S110). The leading end of the sheet bundle P2 is abutted onto the sheet bundle P1 (step S111). The sheet bundle P2 is stacked onto the folded sheet bundle tray 840 in imbricated state. The sheet bundle detection sensor 849 is turned off (step S112). The conveyor belts 844 and 845 are stopped (step S113).

When the sheet bundle P2 is not a sheet bundle including 10 sheets or below which are coated sheets having low sheet rigidity and are of B4 size or larger, the conveyor belts 844 and 845 are normally rotated (step S115) when the detection of the trailing end of the sheet bundle P2 by the sheet bundle discharge sensor 884 is turned off (step S114). The normal rotation of the conveyor belts 844 and 845 is started after the trailing end of the sheet bundle P2 passes through the pair of second folding conveying rollers 812*a* and 812*b*.

The sheet bundle detection sensor 849 is turned off (step S116). The conveyor belts 844 and 845 are stopped (step S117). The discharge and stacking operations of the first sheet bundle P1 are sequentially performed in steps S118 to S123. After the stacking of the last bundle is completed (step S124), the job is ended.

In this embodiment, when the next sheet bundle P2 is discharged onto the previous sheet bundle P1 stacked onto the folded sheet bundle tray 840, the sheet bundle P1 is set to be moved to downstream in the conveying direction before the leading end of the sheet bundle P2 is abutted onto the sheet bundle P1. In the case of the type of sheet having low rigidity in which the leading end of the sheet bundle P2 hangs down in the substantially vertical direction and the sheet bundle P2 is discharged, the smooth stacking operation is enabled.

The timing at which the conveyance of the sheet bundle P1 to downstream in the conveying direction is started is set according to the type of sheet, size, and the number of sheets of the sheet bundle P2. The amount of overlap of the sheet bundle P1 with the sheet bundle P2 can be optimized. They can be stacked and conveyed while maintaining the imbricated state.

As described above, the timing at which the conveyance of the sheet bundle P1 to downstream in the conveying direction is started is set based on three pieces of sheet information of the type of sheet, size, and the number of sheets. The conveying start timing may be set based on two or one of the three pieces of sheet information.

In this embodiment, the folded sheet bundles P1 and P2 folded into two along the center portion in the conveying direction have been described. The present invention is effective for folded sheets having an open end on the trailing end side and sheets folded in Z shape. Needless to say, a folding apparatus without the press unit 860 can obtain the same effect.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-014686, filed Jan. 26, 2009, No. 2009-296650, filed Dec. 28, 2009 which are hereby incorporated by reference herein in their entirety.

What is claimed is:

1. A sheet post-processing apparatus comprising:

a stacking portion on which a sheet bundle is stacked;

a discharge portion which discharges the sheet bundle onto the stacking portion;

a conveying portion, provided on the stacking portion, which conveys the sheet bundle discharged onto the stacking portion; and a controller which controls to change an interval from a time when the discharge portion starts to discharge a next sheet bundle to a time when the conveying portion starts to convey a previous sheet bundle, in accordance with sheet information of the next sheet bundle.

2. The sheet post-processing apparatus according to claim 1, wherein at a time when the next sheet bundle abuts the previous sheet bundle, a conveying speed of the conveying portion is higher than a discharge speed of the discharge portion.

3. The sheet post-processing apparatus according to claim 2, wherein the controller controls the conveying portion such that an amount of overlap of the previous sheet bundle with the next sheet bundle is changed according to the timing at which the conveyance of the previous sheet bundle downstream in the discharge direction by the conveying portion is started.

4. The sheet post-processing apparatus according to claim 1, wherein the sheet information is at least one of rigidity, thickness, size, and a number of sheets forming the next sheet bundle.

5. The sheet post-processing apparatus according to claim 1, wherein the discharging portion discharges each sheet bundle as a folded sheet bundle with a folded end as a leading discharge end, the sheet post-processing apparatus further comprising:

a folded end process portion which is moved along the folded end of the folded sheet bundle in order to perform a folded end process of the folded sheet bundle, wherein the controller controls the conveying portion such that the conveying portion (i) conveys a previous folded sheet bundle stacked on the stacking portion to a first stacking position where the previous folded sheet bundle does not interfere with the folded end process portion when the folded end process portion is operated for a folded end process of a next folded sheet bundle, and (ii) conveys the previous folded sheet bundle from the first stacking position to a second stacking position, located upstream in the discharge direction of the first stacking position, when the discharge portion discharges the next folded sheet bundle.

6. The sheet post-processing apparatus according to claim 5, wherein the controller controls the conveying portion such that an upstream end in the discharge direction of the previous folded sheet bundle in the first stacking position is located downstream in the discharge direction of an operating region of the folded end process portion.

7. The sheet post-processing apparatus according to claim 5, wherein the controller controls the conveying portion such that the conveying portion conveys the previous folded sheet bundle from the first stacking position to the second stacking position after operation for the next folded sheet bundle of the folded end process portion is completed.

8. The sheet post-processing apparatus according to claim 5, wherein the controller controls the conveying portion such that the next folded sheet bundle discharged by the discharge portion is stacked so that the folded end thereof is overlapped with an upstream end in the discharge direction of the previous folded sheet bundle located in the second stacking position.

9. The sheet post-processing apparatus according to claim 1, wherein the controller controls to change the interval from the time when the discharge portion starts to discharge the next sheet bundle to the time when the conveying portion starts to convey the previous sheet bundle, in accordance with a rigidity of the next sheet bundle.

10. The sheet post-processing apparatus according to claim 1, wherein in a case that a rigidity of the next sheet bundle is lower than a predetermined value, the controller controls the conveying portion to start conveying the previous sheet bundle in the conveying direction such that the next sheet bundle being discharged by the discharging portion comes into contact with the previous sheet bundle while the previous sheet bundle is conveyed by the conveying portion, and in a case that the rigidity of the next sheet bundle is not lower than the predetermined value, the controller controls the conveying portion to start conveying the previous sheet bundle after the next sheet bundle comes into contact with the previous sheet bundle.

11. The sheet post-processing apparatus according to claim 1, further comprising a sheet bundle discharge sensor which detects an end portion of the sheet bundle discharged by the discharge portion, wherein in a case that a rigidity of the next sheet bundle is lower than a predetermined value, the controller controls the conveying portion to start conveying the previous sheet bundle in the conveying direction after a predetermined period from a start of conveying the next sheet bundle passes, and in a case that the rigidity of the next sheet bundle is not lower than the predetermined value, the controller controls the conveying portion to convey the previous sheet bundle according to a detection result of the sheet bundle discharge sensor.

12. The sheet post-processing apparatus according to claim 1, further comprising a sheet bundle discharge sensor which detects an end portion of the sheet bundle discharged by the discharge portion, wherein the controller selects between (1) controlling the conveying portion to start conveying the previous sheet bundle in the conveying direction after a predetermined time from a start of conveying the next sheet bundle passes, and (2) controlling the conveying portion to start conveying the previous sheet bundle according to a detection result of the sheet bundle discharge sensor, in accordance with the sheet information of the next sheet bundle.

13. The sheet post-processing apparatus according to claim 1, wherein the controller selects between (1) controlling the conveying portion to start conveying the previous sheet bundle in the conveying direction, such that the next sheet bundle being discharged from the discharging portion comes into contact with the previous sheet bundle while the previous sheet bundle is conveyed by the conveying portion, and (2) controlling the conveying portion to start conveying the previous sheet bundle after the next sheet bundle comes into contact with the previous sheet bundle, in accordance with the sheet information of the next sheet bundle.

14. The sheet post-processing apparatus according to claim 1, wherein the discharge portion discharges a folded sheet bundle onto the stacking portion with a folded end as a leading discharge end.

15. An image forming apparatus comprising:

an image forming portion which forms images on sheets;

a sheet post-processing apparatus which performs a folding process on the image formed sheets; and a controller that controls the sheet post-processing apparatus, wherein the sheet post-processing apparatus comprises:

a stacking portion on which a sheet bundle is stacked;

a discharge portion which discharges the sheet bundle onto the stacking portion; and a conveying portion, provided on the stacking portion, which conveys the sheet bundle discharged onto the stacking portion, and wherein the controller controls to change an interval from a time when the discharge portion starts to discharge a next sheet bundle to a time when the conveying portion starts to convey a previous sheet bundle, in accordance with sheet information of the next sheet bundle.

16. A sheet post-processing apparatus comprising:

a stacking portion on which a sheet bundle is stacked;

a discharge portion which discharges the sheet bundle onto the stacking portion;

a conveying portion, provided on the stacking portion, which conveys the sheet bundle discharged onto the stacking portion; and a controller which selectively performs one of a first mode and a second mode according to sheet information of the next sheet bundle, wherein in the first mode, the controller controls the conveying portion such that a next sheet bundle being discharged by the discharging portion comes into contact with a previous sheet bundle while the previous sheet bundle is conveyed by the conveying portion, and in the second mode, the controller controls the conveying portion to start conveying the previous sheet bundle after the next sheet bundle being discharged by the discharging portion comes into contact with the previous sheet bundle.

17. The sheet post-processing apparatus according to claim 16, further comprising a sheet bundle discharge sensor which detects an end portion of the sheet bundle discharged by the discharge portion, wherein in the first mode, the controller controls so that the conveying portion starts to convey the previous sheet bundle in the conveying direction after a predetermined time from a start of conveying the next sheet bundle passes, and in the second mode the controller controls so that the conveying portion starts to convey the previous sheet bundle according to a detection result of the sheet bundle discharge sensor.

18. The sheet post-processing apparatus according to claim 16, wherein the controller selects one of the first mode and the second mode according to the rigidity of the next sheet bundle.

19. The sheet post-processing apparatus according to claim 16, wherein the discharge portion discharges a folded sheet bundle onto the stacking portion with a folded end as a leading discharge end.

* * * * *